US005762149A

United States Patent [19]

Donovan et al.

[11] Patent Number: 5,762,149

[45] Date of Patent: Jun. 9, 1998

[54] METHOD AND APPARATUS FOR WELL BORE CONSTRUCTION

[75] Inventors: Joseph F. Donovan; Michael H. Johnson; Daniel J. Turick, all of Spring; Larry A. Watkins, Houston, all of Tex.; Wallace W.F. Leung, Sherborn, Mass.

[73] Assignee: Baker Hughes Incorporated, Houston, Tex.

[21] Appl. No.: 469,968

[22] Filed: Jun. 6, 1995

Related U.S. Application Data

[63] Continuation-in-part of Ser. No. 411,377, Mar. 27, 1995, abandoned.

[51] Int. Cl.[6] ..... E21B 7/08

[52] U.S. Cl. ..... 175/40; 166/313; 166/50

[58] Field of Search ..... 175/40, 50, 61; 166/50, 313

[56] References Cited

U.S. PATENT DOCUMENTS

| | | | |
|---|---|---|---|
| 4,241,787 | 12/1980 | Price | 166/105 |
| 4,296,810 | 10/1981 | Price | 166/265 |
| 4,793,408 | 12/1988 | Miffre | 166/53 |
| 4,805,697 | 2/1989 | Fouillout et al. | 166/265 |
| 4,807,704 | 2/1989 | Hsu et al. | 166/313 |
| 4,816,146 | 3/1989 | Schertler | 210/104 |
| 4,900,433 | 2/1990 | Dean et al. | 210/170 |
| 4,929,348 | 5/1990 | Rice | 210/109 |
| 4,982,794 | 1/1991 | Houot | 166/357 |
| 5,240,073 | 8/1993 | Bustamante et al. | 166/265 |
| 5,296,153 | 3/1994 | Peachey | 210/787 |
| 5,311,936 | 5/1994 | McNair et al. | 166/50 |
| 5,318,121 | 6/1994 | Brockman et al. | 166/313 |
| 5,318,122 | 6/1994 | Murray et al. | 166/313 |
| 5,322,127 | 6/1994 | McNair et al. | 166/313 |
| 5,325,924 | 7/1994 | Bangert et al. | 166/313 |
| 5,353,876 | 10/1994 | Curington et al. | 166/313 |

OTHER PUBLICATIONS

B.R. Peachey, et al, "Downhole Oil/Water Separator Development;" *The Journal of Canadian Petroleum Technology*; vol. 33, No. 7, pp. 17–21, Sep., 1994.

D.A. Cocking, et al "Extended Reach Drilling Eliminates Need For Artifical Island"; *Petroleum Engineer International*; pp. 33–38, Feb., 1995.

R.C. Smith, et al, "The Lateral Tie–Back System: The Ability to Drill and Case Multiple Laterals"; Presented at 1994 IADC/SPE Drilling Conference held in Dallas, Texas; Feb. 15–18, 1994.

T. Justad, et al, "Extending Barriers to Develop A Marginal Satellite Field from an Existing Platform"; Presented at SPE 69th Annual Technical Conference & Exhibition, New Orleans, LA, Sep. 25–28, 1994.

"Innovative Horizaontal Drilling Techniques; Multi–Lateral and Twinned Horizontal Wells," *Sperry–Sun Drilling Services.*

"Innovative Techniques Increase Your Return on Investment," *Sperry–Sun Drilling Services.*

*Primary Examiner*—William P. Neuder

*Attorney, Agent, or Firm*—Umesh M. Desai; Carl A. Rowold

[57] ABSTRACT

A system for producing a field is disclosed. The field includes a main access well with a first branch well extending therefrom. A separator for separating oil and water is placed in the first branch well. In an alternate embodiment, the separator may be contained within the main access well. A second branch well may also extend from the main access well and may contain a disposal assembly that is operatively associated with the separator. The first and second branch wells may intersect the same reservoir or different reservoirs.

30 Claims, 19 Drawing Sheets

METHOD AND APPARATUS FOR WELL BORE CONSTRUCTION

This is a continuation-in-part of application Ser. No. 08/411,377, filed on 27 Mar. 1995, now abandoned.

The invention relates to well bore construction. More particularly, but not by way of limitation, this invention relates to a method and apparatus of drilling, completing, and producing hydrocarbon reservoirs.

Generally, the exploitation of hydrocarbon reservoirs has been achieved by the drilling of a bore hole to a subterranean reservoir. Once drilled, the reservoir may be completed and the reservoir may be produced until the well is plugged and abandoned for economic reasons. In the case where the well bore intersected numerous hydrocarbon reservoirs, the operator may chose to complete to a reservoir with the option to complete to the upper horizons at a later time.

Also, when the well bore intersects at least two different reservoirs, a dual completion is utilized by some operators. In such a case, the two reservoirs are produced with separate production strings.

Advances in drilling and completion techniques have led to the completion of highly deviated wells. This allows a driller to reach reservoirs that are a significant distance from the surface location (known as the throw). Many offshore wells drilled from platforms are drilled utilizing this technique. One prior art technique involves sidetracking from the production casing; however, sidetracking necessarily involves the abandonment of the lower zone in order to reach the upper horizon.

Another prior art technique is the use of extended reach wells. As the throw of wells increases, they are referred to as extended reach wells. The deviation of the well bores may approach 90 degrees in which case the well will have a horizontal portion. The productivity of a well is increased when the length of the completion actually intersecting a productive interval increases. Thus, many wells being drilled utilize the horizontal drilling technique in order to increase productivity.

In order to produce the well, certain surface facilities are required. For instance, separation of the oil, gas and water is crucial. Many times, the wells will be required to have compressor facilities or pressure boosting equipment to aid in production. Process equipment is also needed. Government regulations many times affect the discharges from the well bore, as well as the placement of the well bore. Many fields are now located in exotic regions so that the type, placement and performance of the production equipment is a major obstacle to economic development.

More recently, the use of multilateral wells have been used such as those disclosed in U.S. Pat. Nos. 5,325,924; 5,322,127; 5,318,122; 5,311,936; 5,318,121; and 5,353,876, all assigned to applicant. The multilateral wells include having a first and second lateral (branch) well bore that extends to a single productive interval. The prior art purposes of the multilateral wells has been to have multiple completions that extend laterally through a single subterranean reservoir thereby increasing the productive length of the completion.

Despite these advances, there is a need for a method to construct a well bore that will efficiently and effectively deplete multiple reservoirs. There is also a need for treatment and process facilities that will allow for the down hole processing of subterranean reservoir fluids and gas for this novel method of well bore construction.

SUMMARY OF THE INVENTION

The invention includes a method of drilling a plurality of well bores with a drill string containing sensors sensing subterranean properties of reservoirs, the method comprises the drilling a primary access well bore and measuring physical parameters of the subterranean reservoirs from the primary access well bore. Next, the operator generates a subterranean model of the reservoirs and develops target reservoirs for placement of branch completions.

A casing string may serve as a primary access conduit for multiple branch wells extending therefrom. The placement of the primary access well bore is important so that the entry and placement of the multiple branch wells achieves maximum production and drainage from the multiple reservoirs. The positioning of the branch well bore path will depend on the specific geology of the field as well as certain requirements of the various production equipment that will be contained within the branch wells.

The method may further comprise placing a primary access casing in the primary access well bore and thereafter generating window sections from the primary access casing. The windows are not necessarily in the immediate proximity of the reservoirs (as is the case with prior art wells being generated). Instead, the branch well bore paths will be a function of field geology, drilling concerns and completion concerns.

The method may further comprise the steps of drilling, utilizing the windows, a bore hole to a first target reservoir; then, drilling, utilizing a second window, a bore hole to the second target reservoir. The steps further include completing the first target reservoir with a completion string to the first target reservoir, and completing the second target reservoir with a completion string to the second target reservoir. Some of the possible strings include sand control screens, slotted liners, and consolidated packs such as resin coated sand, all well known by those of ordinary skill in the art.

In one embodiment, the operator may position a first and second valves for variably controlling the flow from the first and second branch. Also included may be sensors sensing the production parameters of the reservoir and produced fluids. Under this scenario, the method further comprises producing a hydrocarbon from the first branch completion and monitoring the production parameters of the first branch completion. Next, the first valve is positioned in the closed position once production of the hydrocarbons drops below a predetermined level while the second valve is positioned in the open position so that a hydrocarbon is produced from the second branch completion.

The invention also allows for cycling amongst the multiple reservoirs. In determining the cycling between the multiple branches, once the estimated productivity of the first branch rises to a predetermined level, various cycling of the multiple branches may occur. One of the measurable parameters will be reservoir pressure. The pressure of the first branch completion is monitored and once the reservoir pressure of the first branch completion rises to a predetermined level, the second valve is placed in the closed position. Other types of sensors are available, such as: flow rate sensor, and/or a fluid composition sensor.

In another embodiment, the invention discloses generating a first window section from the primary access casing then drilling a partial first branch well bore from the first window section, with the first branch well bore extending partially to the first target reservoir. Next, a second window is generated from the primary access casing and thereafter a second branch well bore is drilled from the second window section, with the second branch well bore extending partially to the second target reservoir. Next, the operator would then mobilize a remedial work over rig and reenter the first branch well bore and drill an extended well bore intersecting the first target reservoir and thereafter completing the first branch with a completion string to the reservoir. Next, the second branch is drilled (with the remedial rig) and completed with a completion string to the reservoir similar to the first branch well bore.

Various branch well bores may have disposed therein gas/oil/water separators. Alternatively, the branch well bore may contain process equipment compressing or pumping fluids and gas to the surface. The branch may contain treatment equipment treating the reservoir fluids and gas with treatment chemicals. Alternatively, the branch may contain processing equipment that would treat the fluids and gas for hydration or catalytic transformation of hydrocarbon molecules. Still further, the branch may contain sensors sensing production parameters such as pressure, temperature, fluid composition, and/or water percentage.

A system for depleting a plurality of reservoirs is also disclosed. The system comprises a primary access passage with a first branch well extending from the primary access passage and intersecting a first subterranean reservoir. The system also contains a second branch well extending from the primary access passage, with the second branch well intersecting a second subterranean reservoir.

In one embodiment, the first and second branch well extends from the primary access passage at an optimum trajectory angle for intersection with the first and second subterranean reservoir. The placement of the windows is not dependent on the proximity of target horizons; rather, the criteria is based on a branch well bore path that can be drilled quickly, efficiently, and with minimal tortuosity. Of course, the ultimate paths chosen are based on data known at the time that have been generated in order to model the fields under consideration. As more and more data is generated due to drilling and production quantitative information, the model of the field may change.

The first and second branch well may contain valves variably constricting the first and second branch well from communication with the primary access passage. The first branch well contains a completion string to the reservoir. In order to produce the reservoir, the first branch well includes production equipment enabling production of reservoir fluids and gas, and controlling the production of the reservoir fluids and gas. The second branch well may have contained therein a separator separating the hydrocarbon phase and in-situ water phase produced from the first branch well. Also, a diverter are included diverting the reservoir fluids and gas production from the first branch to the separator.

The system further comprises first and second sensors, operatively associated with the first and second production means, sensing physical parameters of the first and second target reservoirs respectively.

An apparatus for producing a field is also disclosed. The apparatus may be positioned within a main access well with a first branch well extending therefrom. A separator separating oil and water is placed in the first branch well. It should be noted that in an alternate embodiment, the separator may be contained within the main access well. A second branch well may also extend from the main access well and may contain a disposal assembly that is operatively associated with the separator. The first and second branch wells may intersect the same reservoir or different reservoirs.

The separator contains a casing having an inlet and an outlet; a shaft axially mounted within said casing; a plurality of disk, with said disc having an axial center and a circular perimeter, with said axial center of said discs being attached to said shaft. The separator further comprises an inlet, operatively associated with said casing, receiving the fluid stream; a first outlet, operatively associated with said casing, discharging the lighter components of the fluid stream; and a second outlet, operatively associated with said casing, discharging the heavier components of the fluid stream.

A centrifugal pump is also claimed in combination with the separator. The pump contains an impeller blade, attached to said shaft and capable of rotation; and an outer housing attached to said first outlet, with said outer housing being contoured to receive said impeller blade.

The application also discloses an apparatus for producing a subterranean reservoir. The system would include a main well, a completion assembly contained within a first branch well, and a chemical which is adapted for injection into the produced fluids and gas from the completion assembly.

In one embodiment, the first branch well and second branch well extend from the main well, and the chemical is stored within one of the branches. An injector is operatively associated with the slurry. Further, a metering device metering the quantity of chemical injected may also be included. This embodiment may also include a third branch well that has contained therein a separator separating the various liquid and gaseous phases and thereafter disposing the in situ water into an injection reservoir.

In another embodiment, the second branch may contain a packer that sealingly engages the well bore. A tail pipe will extend from the packer, and the tail pipe will contain a landing profile that will have seated therein a chemical container.

A feature of the present invention includes use of a primary access conduit. Another feature includes the use of multiple branches that extend from the primary access conduit. Another feature includes use of separator for separating the oil, gas and water, with the separator being located within one of the branch well bores.

Another feature includes use of a valve placed within the branch well bores that will constrict the flow path so that the reservoir fluids and gas may be restricted or terminated. Yet another feature includes using sensor means in individual branches that will determine important characteristics of the flow, pressure and temperature of the reservoir. A control means, with a preprogrammed logical command sequence, may be included for receiving information from the sensor means, comparing and analyzing the information thus received, and causing an output signal to maneuver the valve means to an open, closed or partially opened position.

Another feature includes use of a compressor or pump in one or more of the multiple branches. Yet another feature is the ability to have multiple branches extending into a single reservoir. Alternatively, multiple branches may extend into multiple reservoirs. Yet another feature allows the placement of chemical treating apparatus in one or more of the branch well bores to treat the produced reservoir fluids and gas.

Still yet another feature includes the use of a down hole disk centrifuge separator and pump. Yet another feature is the lamella disk stack used within the centrifuge separator creates a significant separation area while maintaining a reduced outer diameter for placement into a well bore. Another feature is that the lamella disk stack together with a set of vanes promotes instantaneous acceleration of the feed to achieve the desired centrifugal force for three phase separation and proper deceleration of the effluent for energy recovery before discharge.

An advantage of the present invention includes having multiple well bores intersecting multiple reservoirs and maintaining the ability to selective manage these individual productive intervals. Another advantage includes the capability of partially or fully commingling the production from the multiple reservoirs. Still yet another advantage is the ability of cycling the multiple reservoirs based on production and/or pressure considerations.

Another advantage includes use of a single main access well bore that can reach numerous targets. Another advantage includes placement of down hole equipment in the subterranean branches rather than at the surface. Yet another advantage includes use of less surface equipment in exotic locations which ultimately reduces cost. Still yet another advantage is the ability to deplete an entire field with fewer surface facilities.

Another advantage consist of pressure supporting producing reservoirs with the down hole re-injection of gas or water. Still yet another advantage involves modifying the produced fluid composition to achieve desirable physical properties (i.e. change viscosity, wax or paraffin content) which enhances the value of fluids and/or simplify transportation or other production problems.

Another advantage is the main access well bore serves an analogous role as the prior art surface production headers and manifold in that the main access well bore may serve as the placement point of the headers and manifold with the unique advantage of being down hole rather than at the surface. Thus, the equivalent of a sub-sea template or cluster well development is possible subsurface, for instance, within the main access well bore with the teachings of the present invention.

Yet another advantage is that the motor of the down hole separator and pump rotates both the shaft for the separator as well as the impeller blade for the pump. Another advantage is that the design of the separator and pump eliminates any unnecessary dissipation of energy. Still yet another advantage is that feed streams with high solids content, a macerator is placed upstream of the separator with the macerator driven by the same shaft as the separator and pump.

DETAILED DESCRIPTION OF THE PREFERRED EMBODIMENTS

Figure 1:
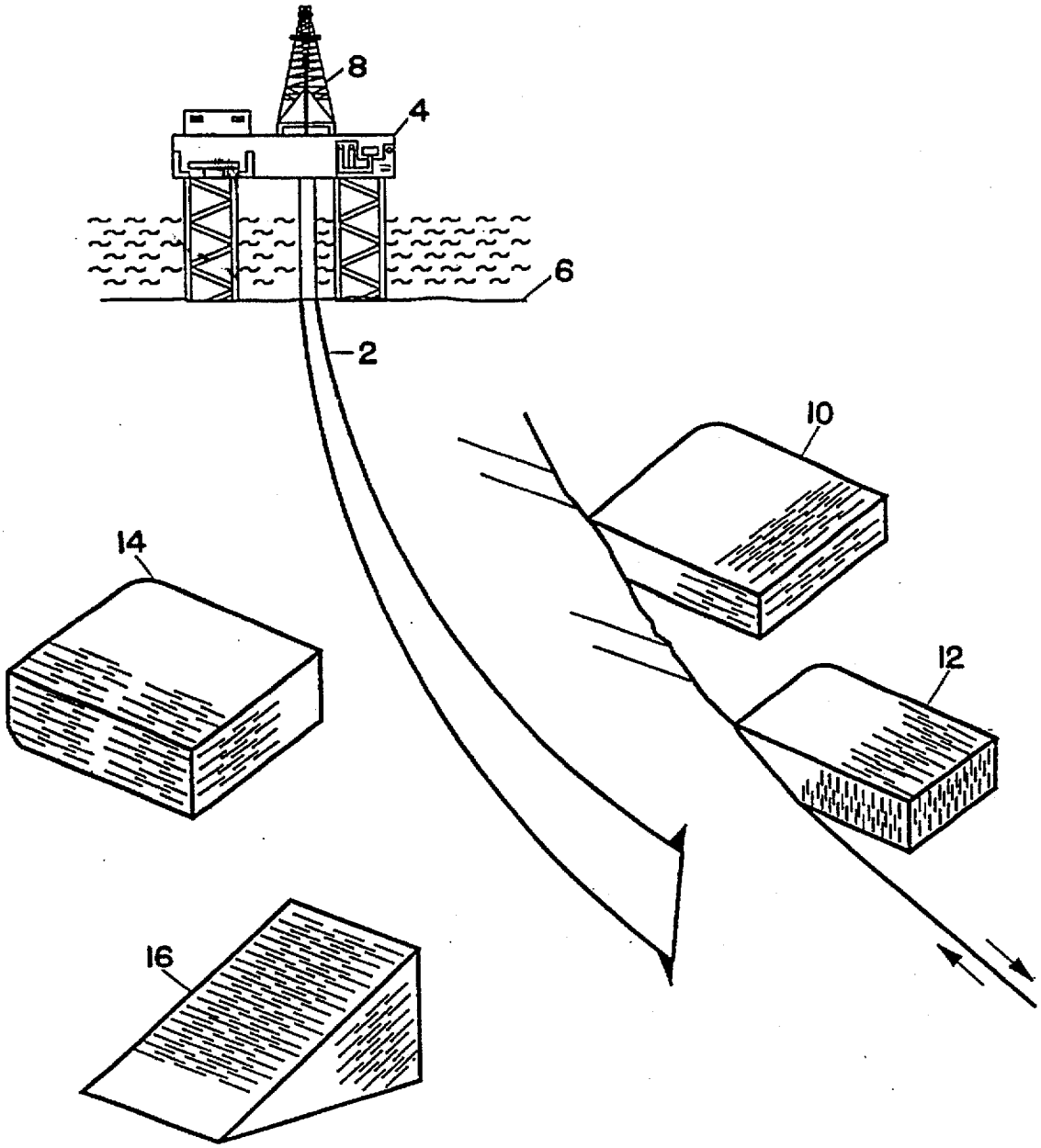
FIG. 1 is a schematic illustration of a main access well bore.

Referring now to FIG. 1, a schematic illustration of a main access well bore 2 is shown. The main access well bore 2 is drilled from a platform 4 that is set on the sea floor 6. While FIG. 1 depicts a platform, the invention is applicable to land uses as well as drill ships, semi-submersible drilling platforms, jack-up rigs, etc. The placement of the main access well bore 2 is dependent on the interpretation of the reservoirs sought to be produced via the novel system disclosed herein. Therefore, the main access well bore 2 does not necessarily intersect any one productive interval. Rather, the main access well bore 2 is placed so that the paths of the branches, to be described later in the application, maximize well bore trajectory and entry angle into the productive zone, which is defined as optimum placement of the branch pathway. In fact, the lower end of the main access well bore may act as a completion without the need of a separate branch.

The platform 4 will have positioned thereon a drilling rig 8 that will serve to drill the main access well bore 2. As is well appreciated by those of ordinary skill in the art, the drill bit will be connected to a drill string (not shown). The drill string will have operatively associated therewith logging sensor sensing the physical parameters of the subterranean reservoirs. In accordance with the teachings of the present invention, the main access well bore 2 will be drilled while continuously monitoring the physical parameters of the subterranean reservoirs. Thus, the operator will be able to use this data, as well as other data such as seismic data, drill stem testing data and other offset well data in which to model the subterranean structure. Of course, the operator has some indication as to location and hydrocarbon potential of reservoirs before drilling. However, the drilling of the main access well bore will further delineate and significantly improve the understanding of the subterranean field leading to a superior model. Also, the drilling of each branch well bore will further delineate and significantly improve the understanding of the subterranean field.

After drilling the main access well bore 2, a development model may be generated. The development model may indicate a plurality of reservoirs. As seen in FIG. 1, the model thus generated based on the seismic data, offset wells, and the drilling of the main access bore depicts a first reservoir 10, a second reservoir 12 and a third reservoir 14. An aquifer 16 has also been identified.

Figure 2:
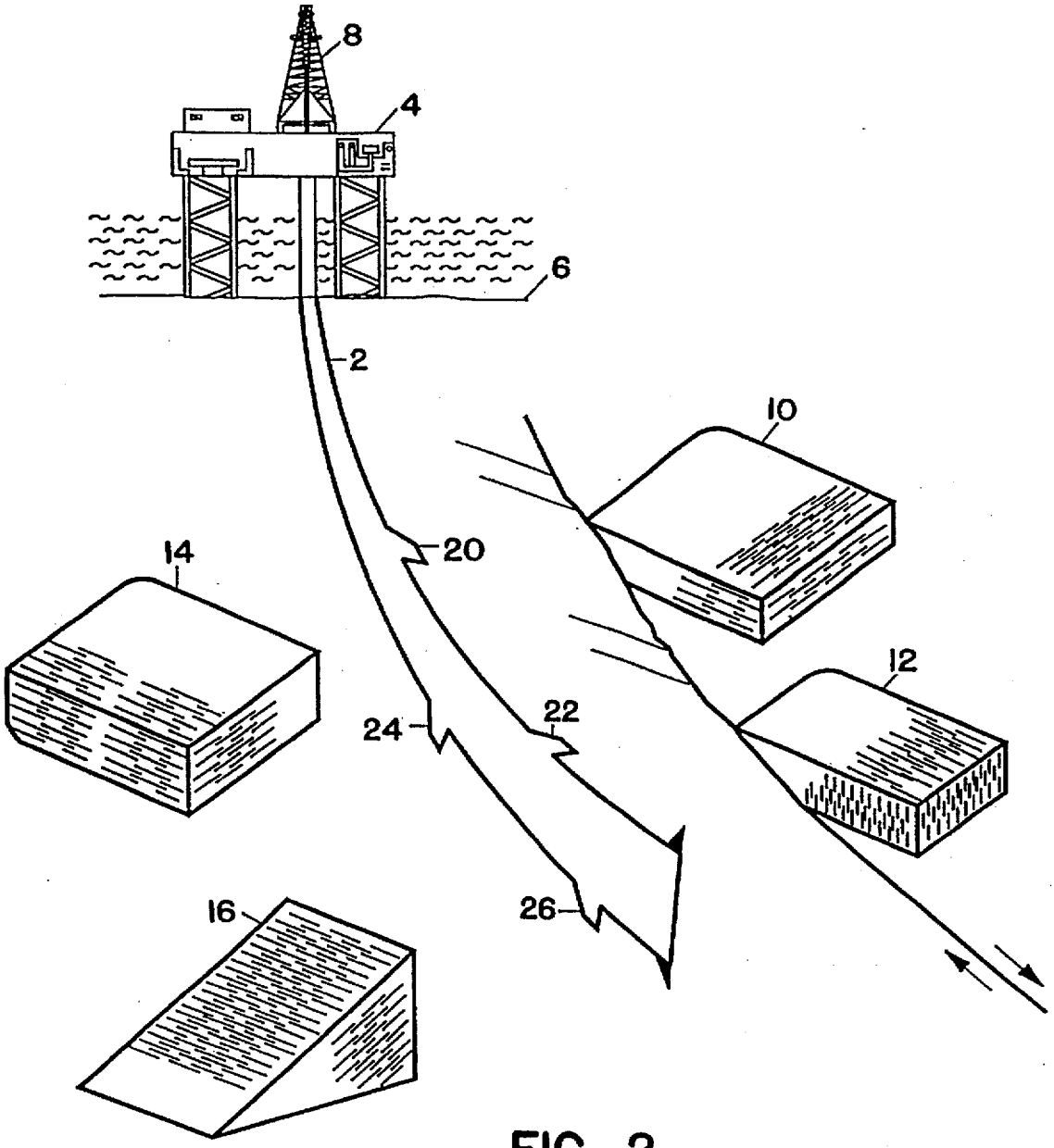
FIG. 2 is the schematic illustration of FIG. 1 with windows generated for placement of branch well bores.

After developing a representative model, the operator may then develop target reservoirs for production, placement of production equipment, all in accordance with the teachings of the present invention. As seen in FIG. 2, after the bore hole has been drilled and the casing string run to the necessary depth, the windows 20, 22, 24, and 26 may be generated from the primary access well bore 2. It should be noted that the drilling rig may be demobilized (taken off) from the platform 4 and a smaller, less expensive, rig may be utilized in order to generate the windows. It should be noted that in the various figures of this application, like numbers refer to like components.

The placement of the windows 20, 22, 24 and 26 is dictated by optimum trajectory path of the branch well bores. Thus, the placement of some branch wells is dependent on the location of the reservoirs containing commercial quantities of hydrocarbons, while placement of other branches may be selected for placement of production and process equipment, which will be discussed hereinafter. It should be noted that placement of the path takes into account not only the longitudinal position but also the deviation desired (or lack of deviation desired) for the specific branch. For instance, a production branch with a high deviation may be selected for a horizontal completion and a branch with a substantially vertical inclination is selected for placement of phase separation equipment.

In an alternate embodiment, the windows may be pre-installed in the casing string at the surface. The location of the window segment would be dependent on the same considerations as the placement and generation of the down hole windows—the ultimate targets and optimum placement of the well bore path to the target. In this embodiment, the casing string (with window segment pre-installed) is run into the bore hole, and thus, milling and generation is not necessary.

Figure 3:
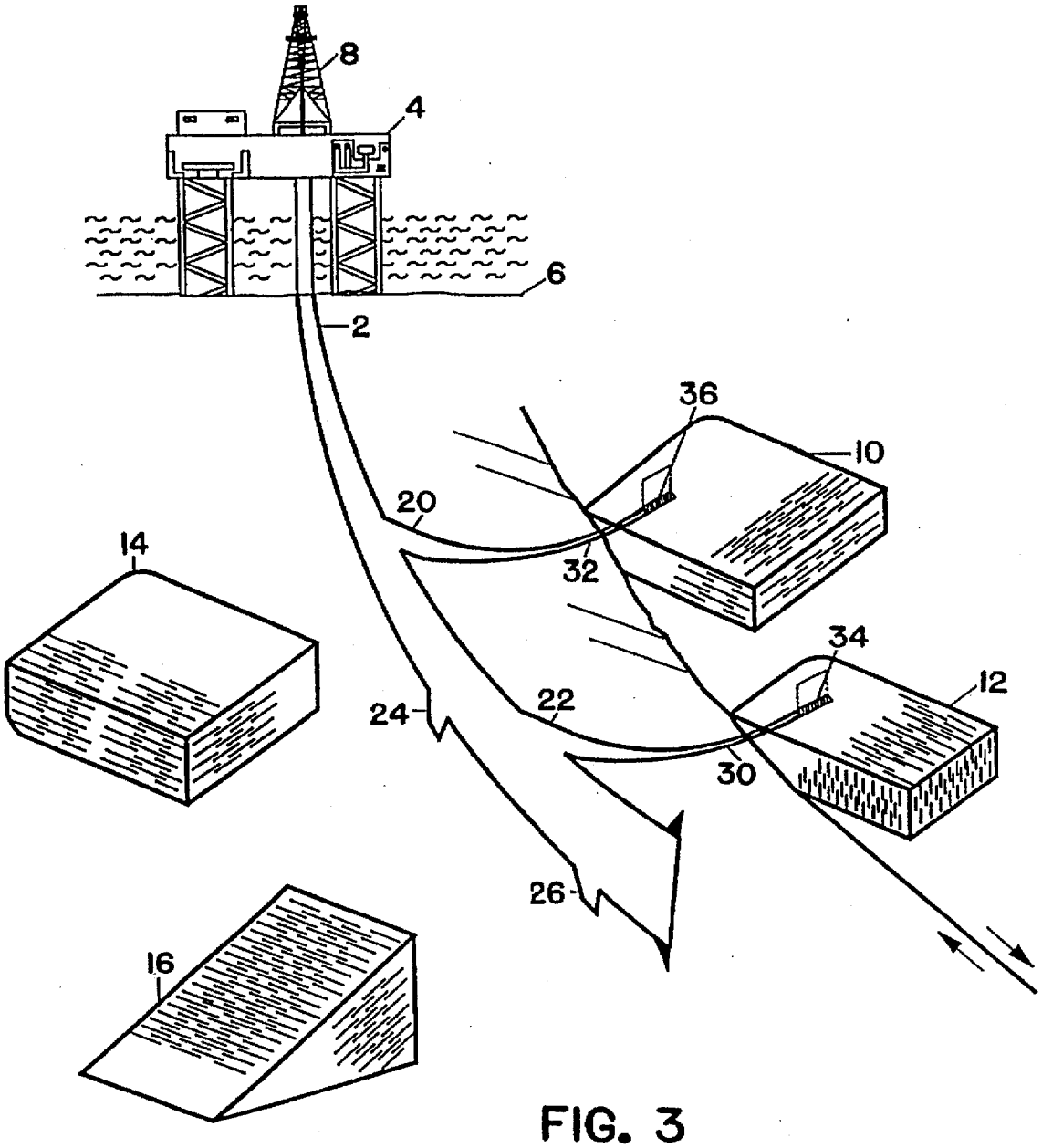
FIG. 3 is the schematic illustration of FIG. 2 a first and second branch well bores.

Referring now to FIG. 3, a first branch well bore 30 and a second branch well bore 32 is depicted. Hence, the method would include generating from the window 22 a branch well bore 30 that ultimately intersects the second reservoir. As depicted in FIG. 3, the branches 30 and 32 are completed to the reservoirs 12 and 10 at optimum trajectories. The actual productive intervals 34 and 36 of the well branches 30 and 32, respectively, are maximized since they are essentially horizontal. However, the path as generated from the windows 20 and 22 allowed for optimum entry and a proper curvature for leading to the horizontal section.

The method of completing the productive intervals 34 and 36 will consist of normal completion methods such as perforating the branch well casing strings 30 and 32. After the perforating, the well bores 34 and 36 may have placed therein sand control devices for preventing the migration of sand into the inner bores of branches 30, 32 as is well known in the art.

Figure 4B:
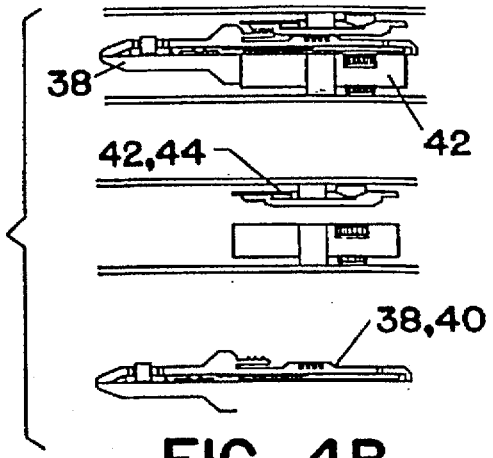
FIG. 4B is an enlargement of the valve from FIG. 4A.
Figure 4A:
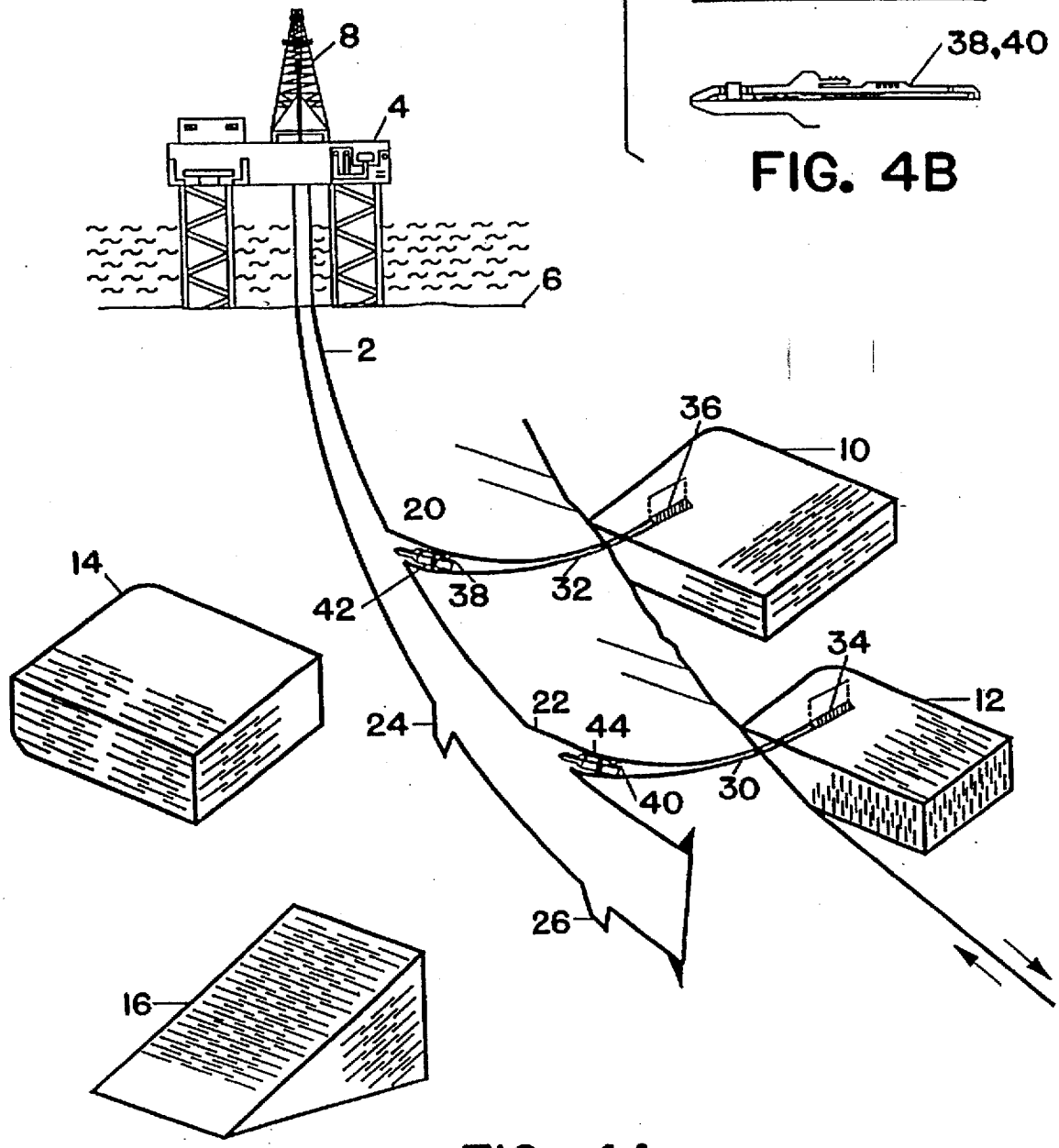
FIG. 4A is the schematic illustration of FIG. 3 showing the utilization of a valve.

As illustrated in FIGS. 4A and 4B, the branches 30 and 32 will also contain flow control devices 38 and 40 controlling the flow of the reservoir fluids and gas into the main access well bore 2. The flow control devices 38, 40 will be placed into a landing profile or landing receptacle 42, 44 respectively. As used in this application, the flow control devices could be a choke that would allow for a variably reduced flow area, or a valve having an open position and a closed position, or a check valve that would be pressure sensitive and allow for flow in one direction but would prohibit flow in the opposite direction. The mechanism and method of placing the flow control valve means 38, 40 into the landing receptacles 42, 44 will described in greater detail later in the application. FIG. 4B depicts the flow control devices 38, 40 within the landing profile 42, 44.

The flow control devices 38, 40 could also have a microprocessor and sensors operatively associated therewith. The sensors would sense certain production parameters such as pressure, resistivity, fluid composition, temperature, oil-water ratio gas-oil ratio etc. Based on a pre-determined criteria, once the information has been processed and interpreted with the down hole microprocessor control, the microprocessor would then generate an output signal to the flow control devices which could be to open, close and/or constrict the flow control device. Moreover, the actual microprocessor could be disposed within the down hole flow control devices, or within a central unit located within one of the branches or even within the main access well bore. The sending of signals down hole to the microprocessor in order to manipulate the control flow devices is also possible. The microprocessor control may receive and transmit through hard wired connection, acoustically linked, optically linked, etc. The flow control devices could also be used in conjunction with the separator pump disclosed herein.

Figure 5:
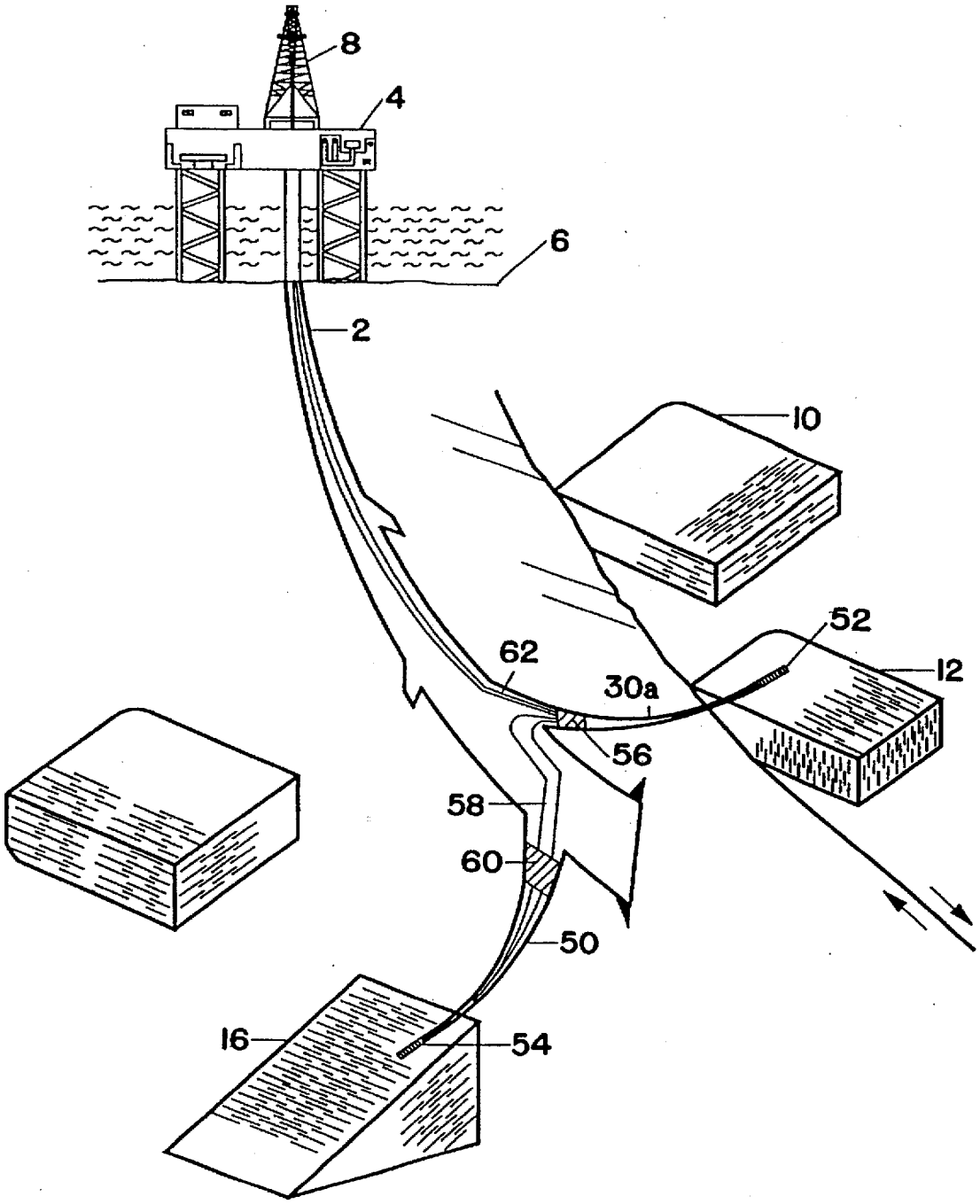
FIG. 5 is a schematic illustration depicting a first and second branch well bores utilizing separator and water injection.

Other types of well branching is certainly possible. For instance, a scenario is illustrated in FIG. 5 wherein the branch well bore 30A has been completed to the hydrocarbon reservoir 12. A second branch well bore 50 has been drilled and completed to the aquifer 16. In the embodiment depicted in FIG. 5, the location of the window has been selected based on the optimum trajectory angles of the branch well bores 30A and 50 in conjunction with the entry and physical placement within the subterranean reservoir 12 and aquifer 16. The branch well bore 30A will be completed 52 to the reservoir 12 as previously described so that the well bore 30A is capable of producing the reservoir's 12 fluids and gas. Further, the branch well bore 50 is similarly completed to the aquifer 16, except that the completion 54 is such that the fluids may be injected via the completion 54 into the aquifer 16.

Figure 15:
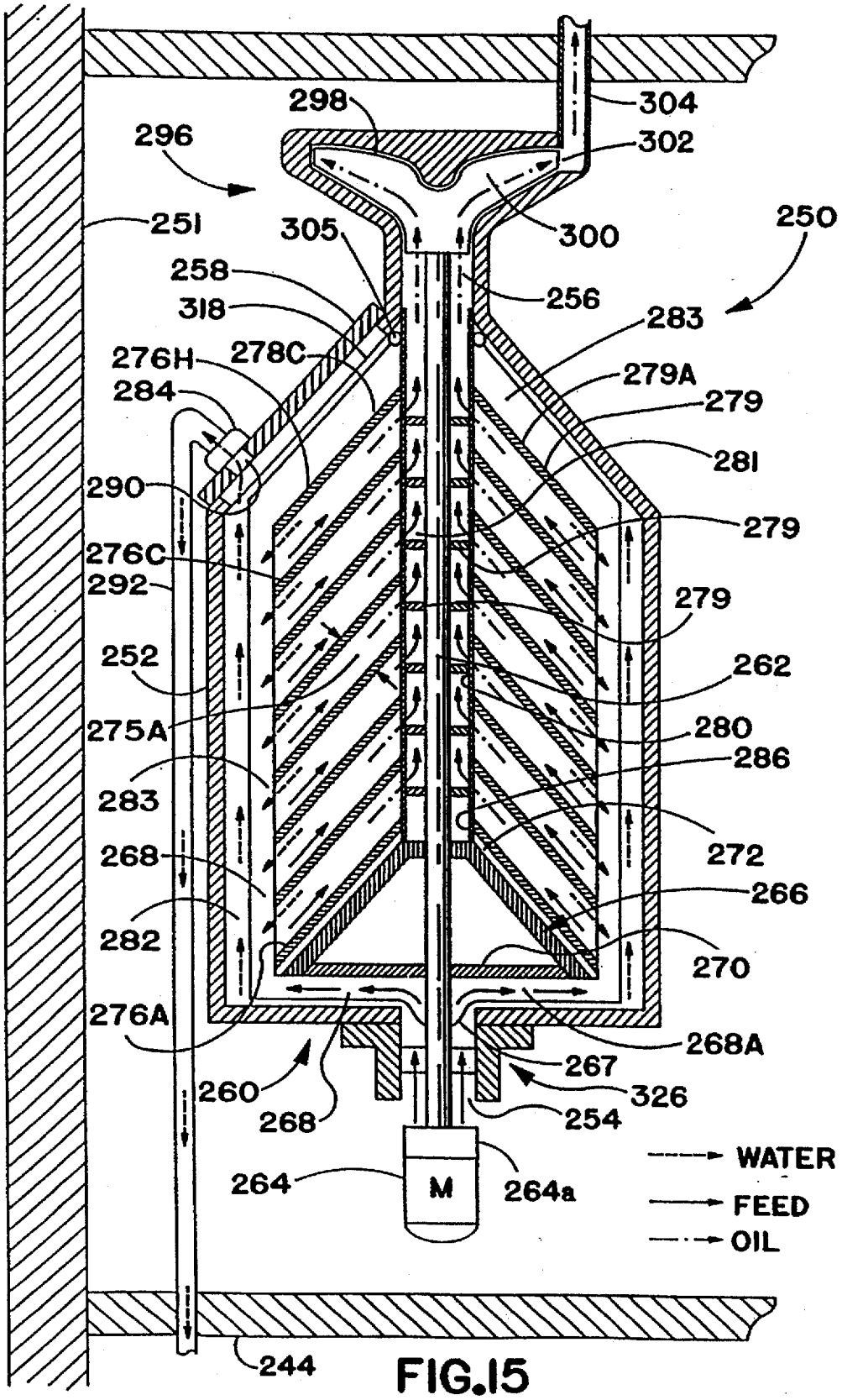
FIG. 15 is a schematic illustration of a down hole separator and pump embodiment of the present invention.

The branch well bore 30A will have disposed therein a separator 56 for the separation of the hydrocarbon phase and water phase of the reservoir fluid. A novel separator, as more fully depicted in FIG. 15, is disclosed herein that is uniquely suited for use with the novel well bores constructed according to the teachings of this application. The unique features and elements of this separator/pump will be fully described later in the application. Examples of other types of separators that may be used herein are found in U.S. Pat. Nos. 4,241,787 and 4,296,810 to Mr. E. Price. Another type of separator is disclosed in "Downhole Oil/Water Separator Development", The Journal Of Canadian Petroleum Technology, Vol. 33, No. 7 (1994) by Peachey and Matthews. Still yet another separator is seen in U.S. Pat. No. 4,766,957 to Mr. McIntyre. Thus, flow from the reservoir enters into the internal diameter of the branch well bore 30A and enters the separator 56 as shown in FIG. 5. The separator 56 will separate the water and hydrocarbon phase.

The diverter tubing 58 leads from the separator 56 to a waste water pump 60 that is sealingly engaged within the branch well bore 50. The waste water pump 60 will be capable of receiving the water which has been separated from the separator 56 and injecting the water into the aquifer via the completion 54. As noted earlier, a novel separator/pump embodiment is shown in FIG. 15, and will be described later in the application. Other examples of waste water pumps 60 are found in the previously mentioned "Downhole Oil/Water Separator Development", The Journal Of Canadian Petroleum Technology, Vol. 33, No. 7 (1994) by Peachey and Matthews.

The separator 56 will have extending therefrom the production tubing 62 which will deliver the fluid and natural gas to the main access well bore 2 after separation. Hence, the fluid entering the main access well bore from the production tubing 62 will not contain large amounts of produced water from reservoir 12. The separator may contain various sensors sensing down hole conditions such as inlet pressure, outlet pressure, and temperatures. Also included will be sensors sensing the water-oil ratio inlet and outlet so that the efficiency of the separation may be monitored. These sensors could be allowed to communicate the collected information up hole as previously described, or alternatively, the data is processed down hole and the appropriate output signals may be generated therefrom. In other words, the data is processed and stored down hole, and a set of predetermined logical commands will be implemented after the criteria is met.

Figure 6:
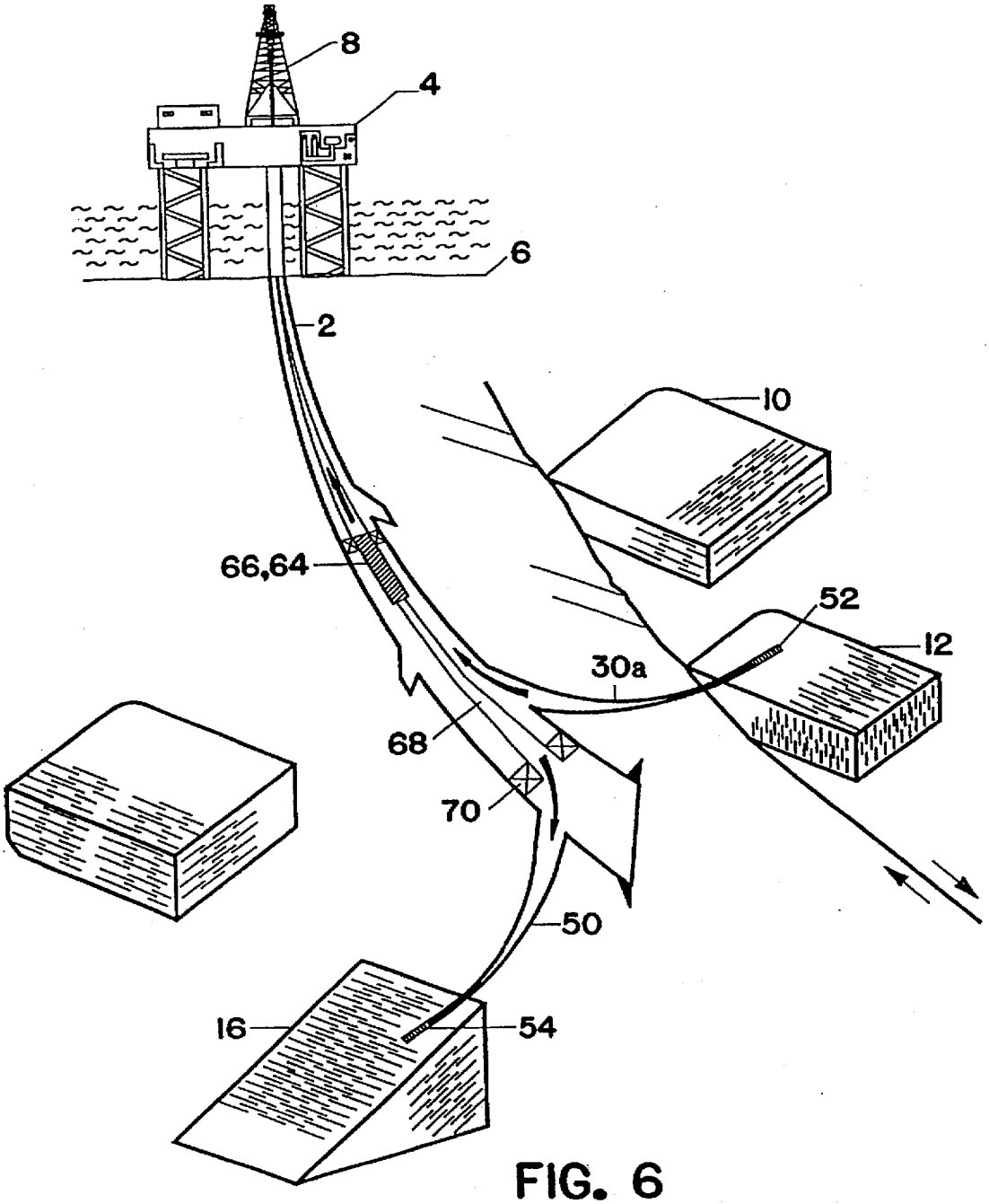
FIG. 6 is a schematic illustration depicting a first and second branch well bore utilizing another separator and water injecting embodiment.

Referring now to FIG. 6, an alternate embodiment depicting a separator 64 for separating the hydrocarbon phase and water phase of the produced reservoir fluid. The separator 64 will be sealingly engaged within the main access well bore 2. In the embodiment shown in FIG. 6, the produced reservoir fluids and gas will be produced via the branch well bore 30A from the completion 52. The produced fluids and gas will then be delivered to the main access well bore 2 and will enter the water separator 64 and will be separated into an oil/natural gas phase and a water phase. The separator of FIG. 15, as well as the other examples previously mentioned would be suitable separators for the embodiment of FIG. 6.

As shown in FIG. 6, the separator 64 will have operatively associated therewith a waste water pump 66 that will take the separated water and pump the water via the injection conduit 68 for ultimate injection into the aquifer 16. The separator of FIG. 15, as well as the other examples previously mentioned would be suitable separators for the embodiment of FIG. 6. It should be noted that a packer 70 is set within the main access well bore 2 so that the flow from the separator is diverted to the branch well bore 50 for ultimate delivery to the completion 54 and injection into the aquifer 16.

In operation, the reservoir 12 is allowed to produce the reservoir fluids and gas via the branch well bore 30A. The flow from the reservoir will enter the main access well bore 2 and be collected within the separator 64. The liquid hydrocarbons and natural gas will be delivered to the main access well bore 2 for production to the surface. The water separated therefrom will be pumped down to the completion 54 for injection into the aquifer 16. Sensors sensing the physical parameters of the down hole environment would also be included as previously described. Sensor placement would include at the outlet and inlet of the separator and pump.

Figure 7:
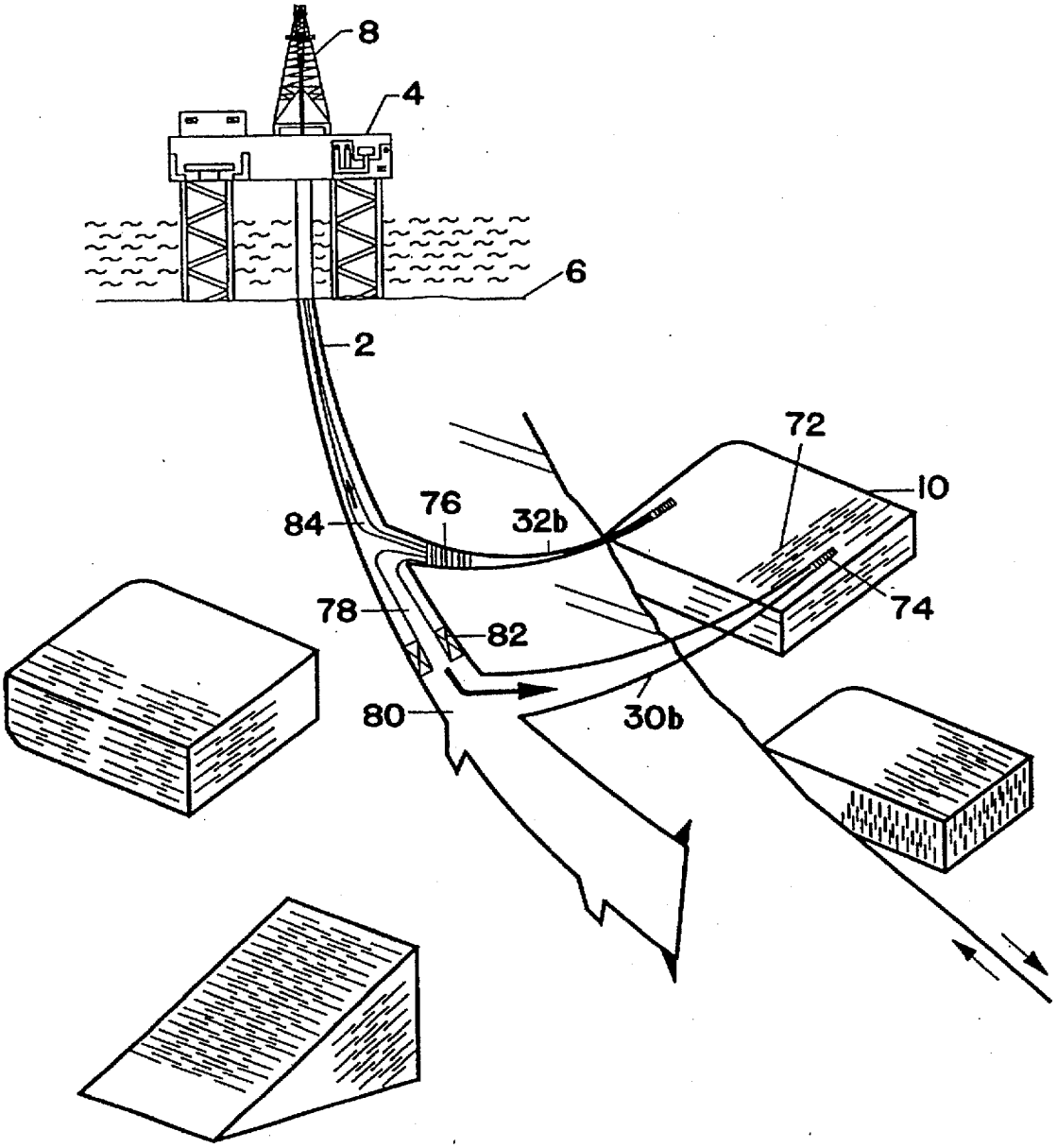
FIG. 7 is a schematic illustration depicting a first and second branch well bore utilizing yet another separator and water injecting embodiment.

A third embodiment of use of the separator is seen in FIG. 7. In this embodiment, the branch well bore 32B extends to the reservoir 10. The reservoir 10 will be an oil reservoir having an oil-water contact represented at 72. The branch well bore 30B will extend into the same reservoir 10, and in particular, will be completed with completion 74 in the water zone. A separator 76 for separating the hydrocarbon phase from the in-situ water phase is sealingly engaged within the branch well bore 32B. The separator of FIG. 15, as well as the other examples previously mentioned would be suitable separators for the embodiment of FIG. 6.

The separated in-situ water phase is diverted via the diverter tubing 78 to be delivered to the lower annulus 80 of the main access casing 2. The diverter tubing 78 will be disposed within a packer 82 for sealingly engaging the main access well bore 2. The separated oil and natural gas will be delivered to the production tubing 84 for ultimate production to the surface. Thus, the in-situ water will be disposed of within the reservoir 10, and more particularly, within the water zone. This will have the beneficial effect of maintaining pressure within the reservoir 10 as well as initiating secondary recovery via this modified water flood. Sensors sensing the physical parameters of the down hole environment would also be included as previously described. Sensor placement would include at the outlet and inlet of the separator and pump.

Figure 8:
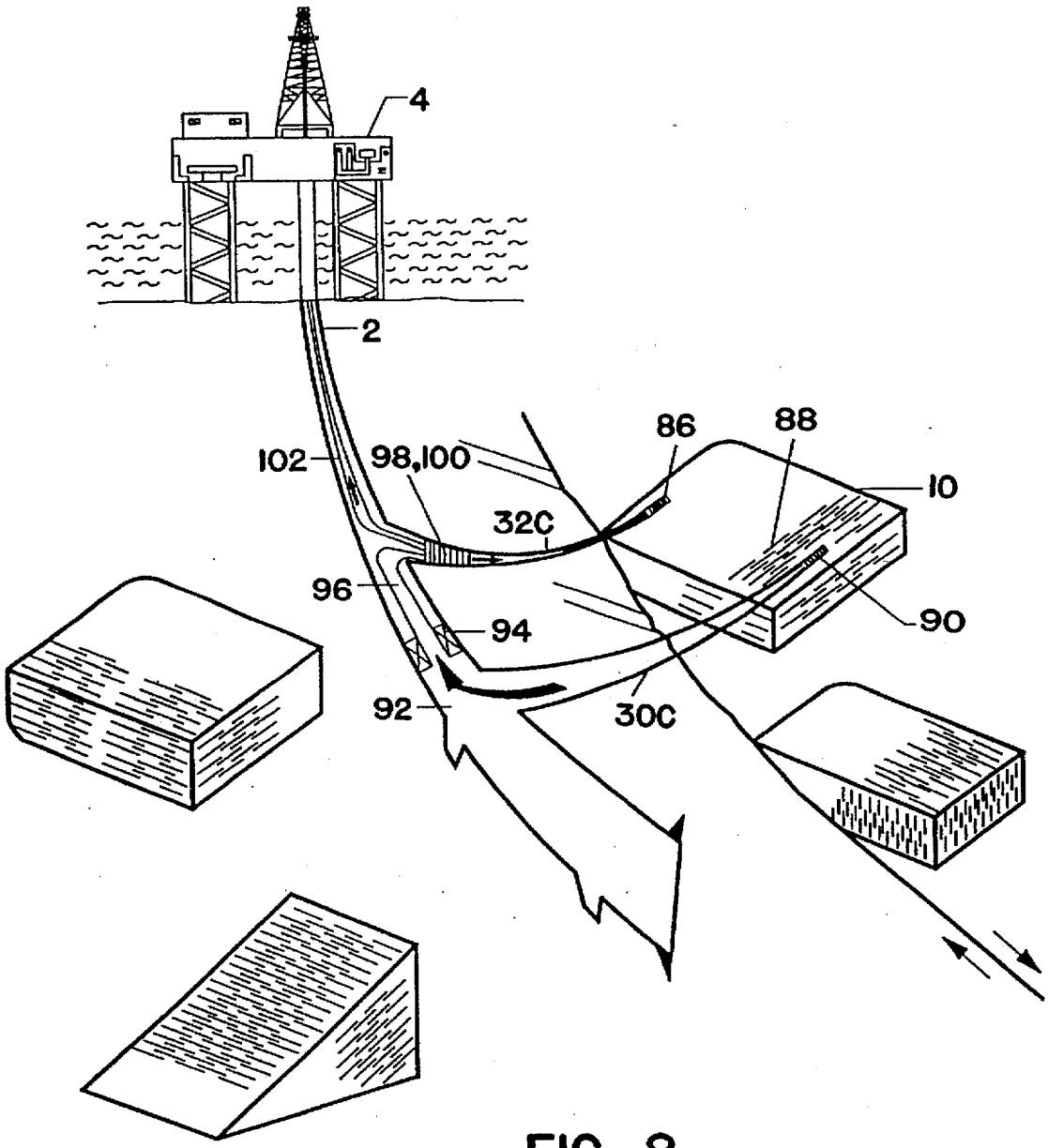
FIG. 8 is a schematic illustration depicting a first branch well bore and second branch well bore with gas recycling.

With reference to FIG. 8, another embodiment of the present invention depicts the branch well bore 32C being completed 86 to the reservoir 10. In this particular embodiment, the reservoir 10 has a gas cap with the gas-oil contact represented at 88. The branch well bore 30C extends into the same reservoir 10, and in particular into the oil zone, with the completion 90 allowing the hydrocarbon fluids and gas to flow into the branch well bore 30C. Ultimately, the flow proceeds into the main access well bore's lower annulus 92. The lower annulus will have disposed therein a packer 94 for sealingly engaging the main access well bore 2. Extending from the packer 94 will be the diverter tubing 96 that is operatively connected to a separator 98 separating the fluids and gas. The separator 98 will have connected thereto a pump 100 that will pump the separated gas via the branch 32C and completion 86 into the gas cap so that the produced gas is recycled into the reservoir 10. The separator/pump of FIG. 15, as well as the other examples previously mentioned would be suitable separators for the embodiment of FIG. 8. Pressure maintenance may be important for several reasons including maintaining the reservoir pressure above the bubble point pressure. Leading from the separator 98 will be a production tubing 102 for delivery to the surface. The pump may also be used to assist in delivery of oil to surface.

Figure 9A:
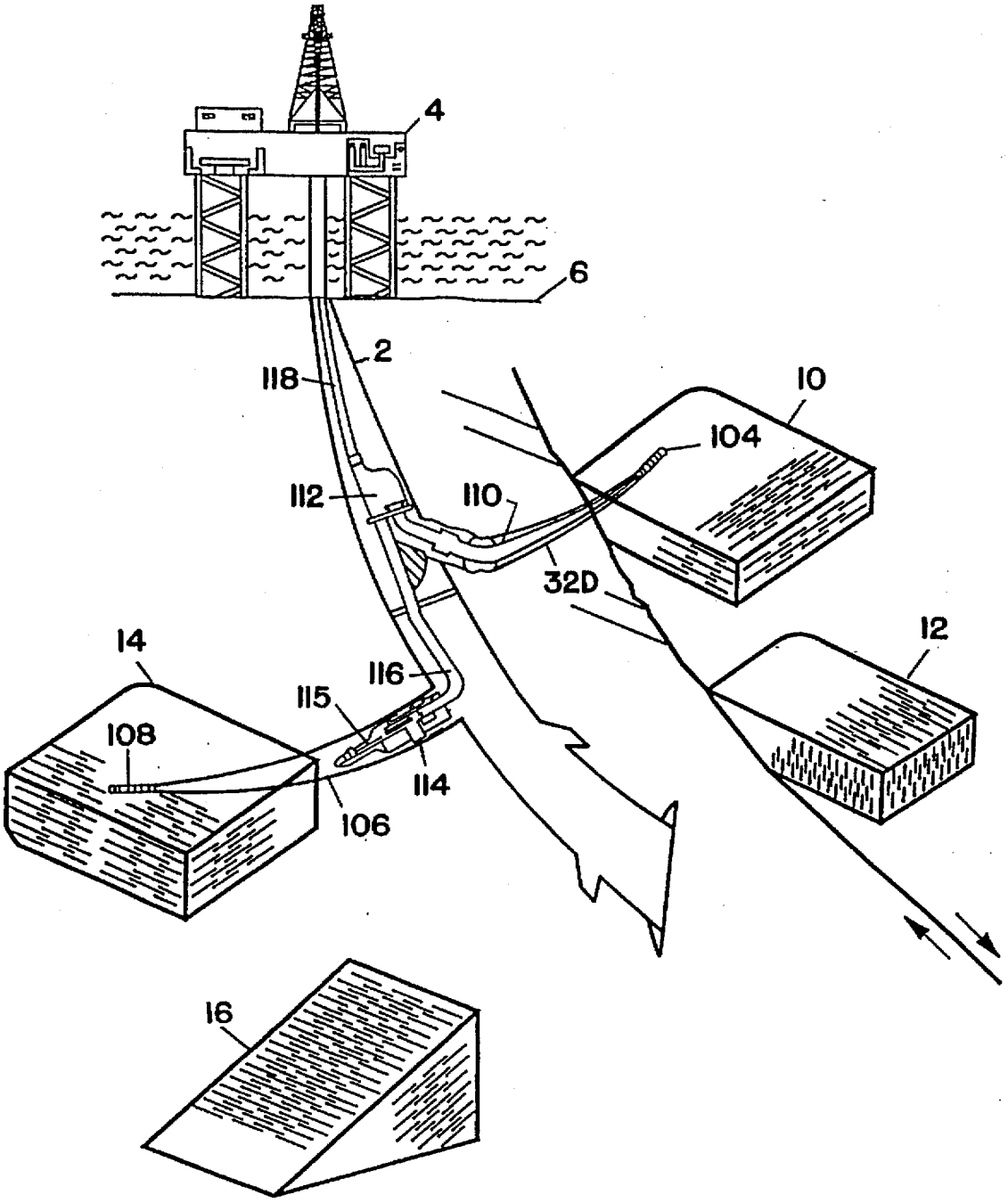
FIG. 9A is a schematic illustration depicting a first and second branch well bore with flow control in the second branch.

FIG. 9A shows another embodiment possible with the disclosure of the present invention in order to produce hydrocarbons. In this embodiment, the main access well bore 2 has two branch wells extending therefrom with the branch 32D being completed with completion 104 to the reservoir 10 which in this embodiment will be an oil reservoir. The branch well bore 106 will be completed with the completion 108 to the reservoir 14 which in this case is a gas reservoir. A diverter tubing 110 will extend to the commingling assembly 112.

The branch well bore 106 will contain flow control device 114 for regulating the flow of natural gas from the reservoir 14. The flow control 114 will be seated within the branch well bore 106 and will have disposed therein a valve 115. A diverter tubing 116 will lead to the commingling assembly 112.

The flow control device 114, 115 may be a pressure sensitive device that would allow natural gas to enter into the diverter tubing and ultimately into the commingling assembly 112. It may also be controlled utilizing the previously discussed microprocessor control. The intermittent flow of natural gas will allow for the lifting of reservoir fluids into the production tubing 118. This is particularly useful when the pressure of reservoir 10 becomes sufficiently depleted that the reservoir pressure is no longer capable of supplying sufficient lifting capacity of the reservoir fluids.

Figure 9B:
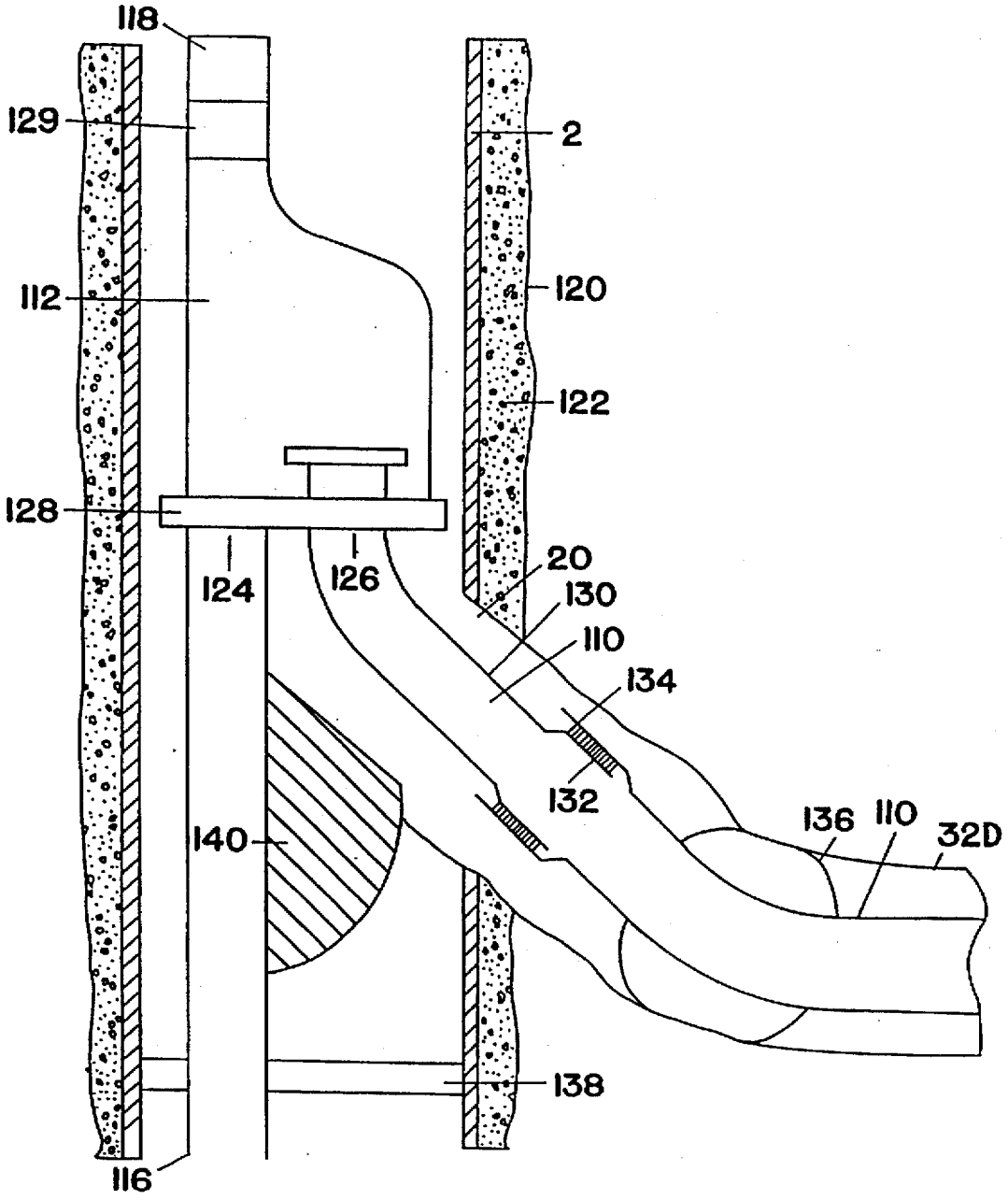
FIG. 9B is an enlargement view of the commingling device of FIG. 9A.

Referring now to FIG. 9B, an enlargement of the commingling assembly 112 is shown. It should be noted that the commingling assembly used herein was described in FIGS. 9A–9C of U.S. Pat. No. 5,322,127, assigned to applicant, and is incorporated herein by reference. Referring to FIG. 9B, the main access well bore 2 has been placed within the bore hole 120 and thereafter set into a cement annulus 122 as is well understood by those of ordinary skill in the art. The commingling assembly 112 generally consist of an enlarged section having a first input 124 and a second input 126 that is disposed within an extendable key and gauge ring member 128 of the commingling assembly 112. The commingling assembly also includes a swivel assembly 129 that is operatively associated with the production tubing 118.

The first input section 124 is connected to the diverter tubing 116 and the second input 126 is connected to an intermediate tube 130 that has at one end a set of seal members 132 that will sealingly engage with a polished bore receptacle 134. The polished bore receptacle is contained on one end of the diverter tubing 110. Also contained on the diverter tubing 110 is the centralizers 136.

A packer 138, which may be a hydraulic or mechanical type of packer, for sealingly engaging the main access well bore 2 is provided. As contained within the main access well bore 2 is the whip stock diverter 140 that is used for generation of the window 20. Thus, the completion 104 is isolated from the completion 108.

Figure 10:
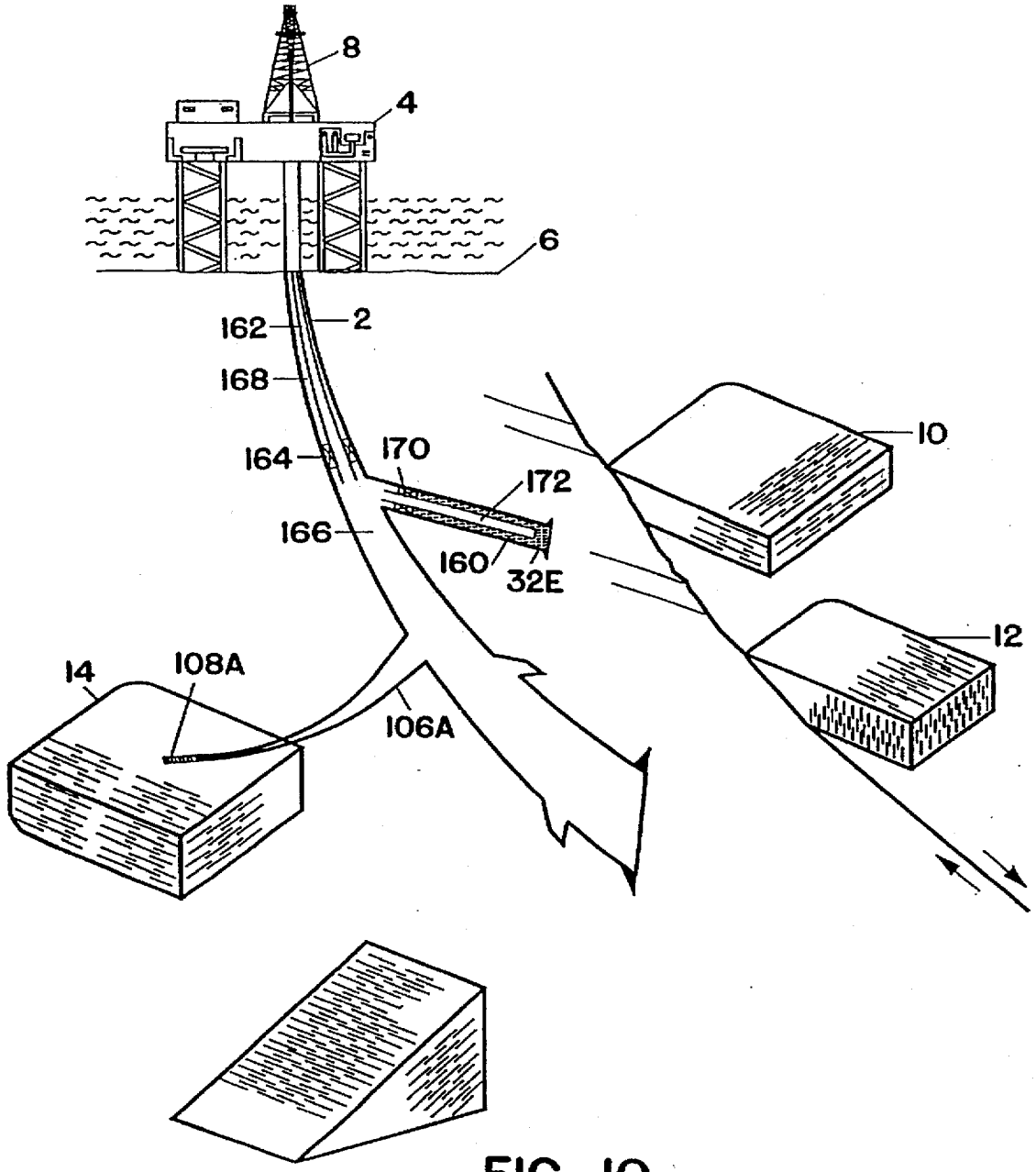
FIG. 10 is a schematic illustration depicting a first branch well bore for production and a second branch well bore for treatment of produced fluids.

Another embodiment of the present invention is depicted in FIG. 10. In this embodiment, the branch well bore 106A will extend to the reservoir 14 which will be a hydrocarbon bearing reservoir. The branch well bore 106A will be completed via the completion means 108A for allowing the flow of hydrocarbon fluids and gas to flow from the reservoir 14 through the completion 108A and into the well bore 106A for ultimate production to the surface.

A second branch well bore 32E has also been provided, but unlike the previous branch well bores 32–32D, the branch well bore 32E will not necessarily intersect a reservoir. Thus, as shown in FIG. 10, the branch well bore 32E extends from the main access well bore 2 at an optimum angle so that chemical treatment facilities means 160 for treating the reservoir fluids and gas produced from the reservoir 14. The actual well casing may need to be manufactured from a special alloy in order to prevent the stored chemical from reacting over time.

In this embodiment, the main access well bore 2 will have contained therein a production tubing 162 with the production tubing string being operatively associated therewith a production packer 164 which will form a lower annulus 166 and an upper annulus 168. Hence, as the reservoir fluids and gas enter into the lower annulus 166, production to the surface will be via the route of the production tubing 162.

The chemical treatment facilities means could have different types of chemicals, with the necessary injector capacity in order to introduce the specific chemical (or chemicals) into the lower annulus 166 for ultimate mixing and exposure to the reservoir fluids and gas production. A metering device may also be included in order to introduce a precise amount of chemical. In one type of chemical treatment, the treatment may be to prevent the formation of hydrates within the lower annulus 166 and within the production string 162 and into the surface facilities (not shown). Some other types of chemicals that may be placed within the treatment branch well bore 32E include corrosion inhibitors for the prevention of corrosion in the down hole and surface tubular. Also, a paraffin inhibitor may be placed within branch 32E for the deterrence of paraffin precipitation within the tubing 162 and surface facilities. Other chemicals may include emulsion breakers, water clarifiers, Hydrogen Sulfide scavengers, and scale inhibitors.

By mixing the treatment chemical with the reservoir fluids and gas downhole, certain benefits are obtained such as introduction of hydration inhibition chemicals prior to reaching up hole pressure and temperature which would promote formation of hydrate plugging. Another benefit is that intermittent down hole injection correlated to shutdowns of the system will permit loading of flow lines and other deposition prone areas with the treated (inhibited) produced fluids.

The method and apparatus of landing the treatment apparatus within the branch well bore 32E may essentially consist of landing a packer 170 within the well bore 32E, with the packer having extending therefrom a tail pipe section 172 with the tail pipe section having attached thereto the treatment means 160. It should be noted that the quantity of chemical actually stored may be a finite amount; however, since the branch well bore 32E may extend for several thousand feet from the main access well bore, the quantity held within this chemical facilities means can be quite significant.

Figure 11:
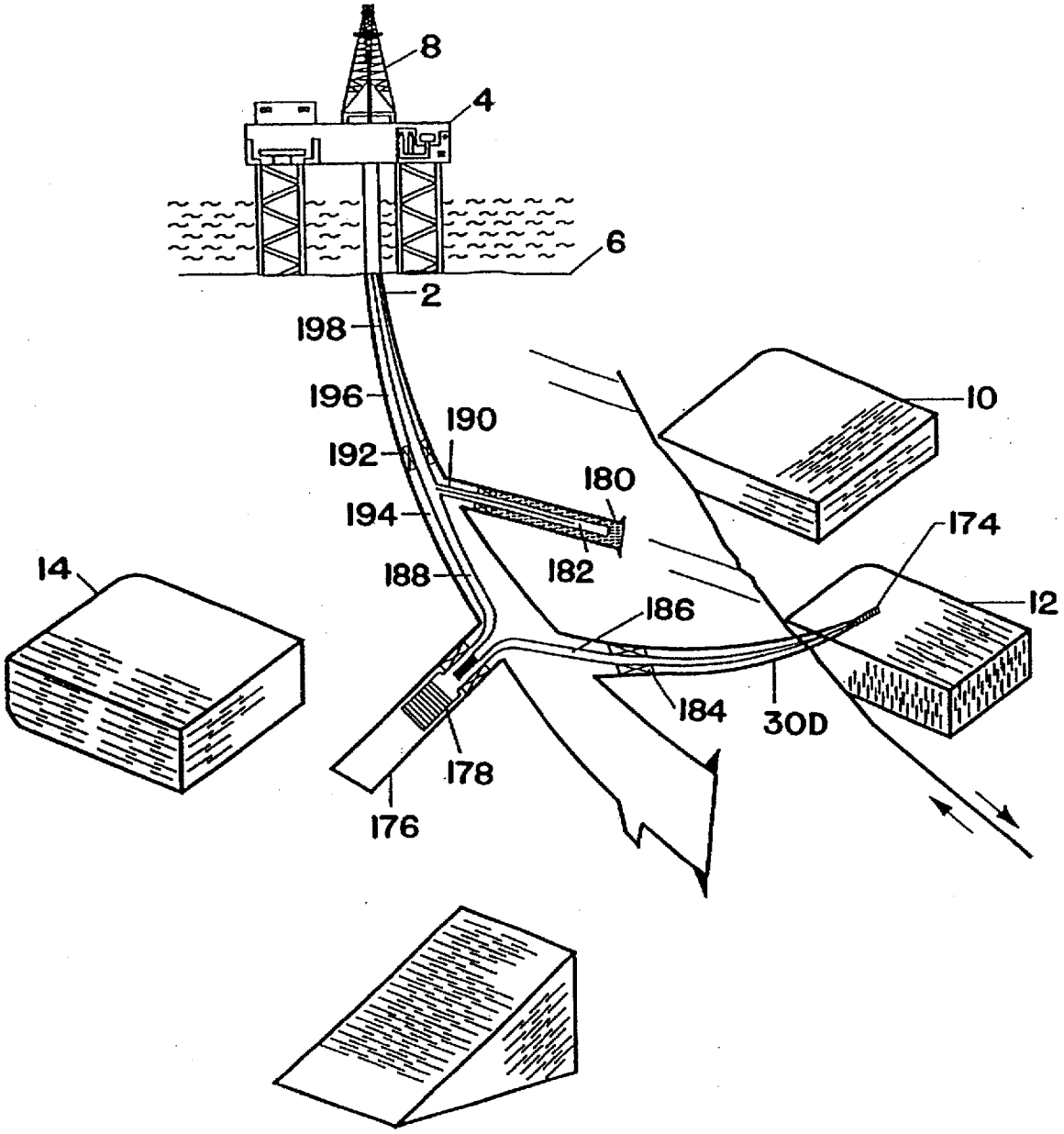
FIG. 11 is a schematic illustration depicting a first branch well bore for production, a second branch well bore for treatment and a third branch well bore for treatment.

Referring now to FIG. 11, another embodiment is disclosed that shows the use of multiple process/treatment branches. The branch well bore 30D will be completed to the hydrocarbon reservoir 12 via the completion 174 for producing the reservoir's 12 fluids and gas. Also extending from the main access well bore 2 will be the branch well bore 176 that will have contained therein process equipment 178 such as water separator and injector as previously mentioned and which will be described hereinafter.

A third branch well bore 180 may also extend from the main access well bore 2. The well bore 176 may contain process equipment 182 which in one embodiment may be a catalyst bed to crack the hydrocarbon fluids produced from the reservoir 12 via the completion 171. The benefit of such a treatment process is that the modified hydrocarbon molecular composition may be less likely to wax or build up paraffin deposit in the down hole tubular as well as the surface facilities. Of course, other types of process equipment 182 may be included such as the separator/pump of FIG. 15.

Thus, the branch 30D will contain a packer 184 for sealingly engaging the branch 30D. Extending from the packer will be the diverter tubing 186 which will extend to the branch well bore 176 and in particular for the separation with the separator 178 of the reservoir fluids and gas as previously set out in FIGS. 5, 6, and 7. The hydrocarbon fluid and gas will then be transferred via the diverter tubing 188 to the process equipment 182 for catalyzing and cracking the hydrocarbon molecular structure. After appropriate treatment, the fluid and gas stream will be delivered via the diverter tubing 190.

The main access well bore 2 will have disposed therein a packer 192 which will create a lower annulus 194 and an upper annulus 196. The packer 192 will have extending therefrom the production tubing 198. The diverter tubing will deliver the hydrocarbon stream to the production tubing 198 for transporting to the surface as is well known in the art.

Figure 12:
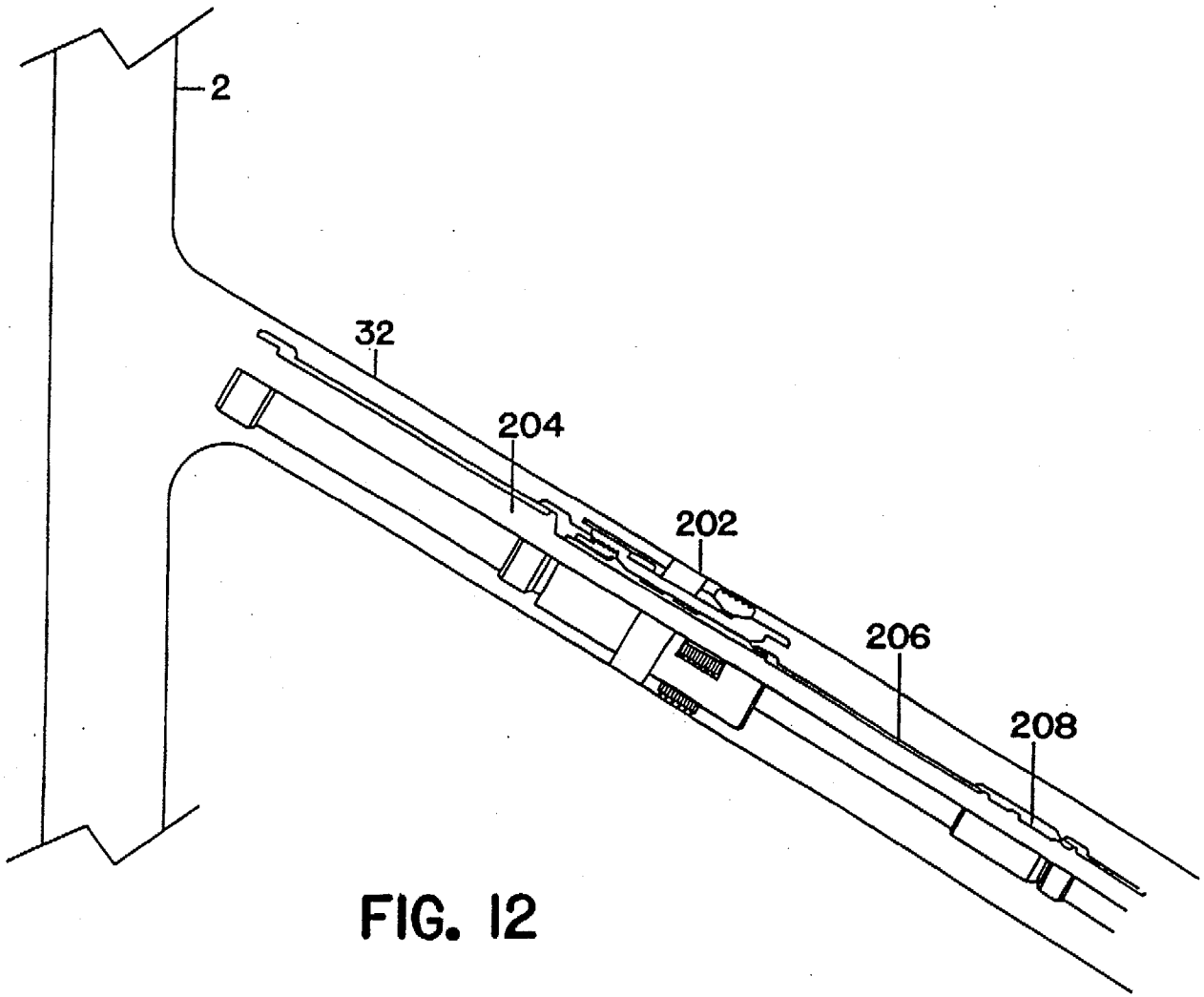
FIG. 12 is schematic illustration of a seal sealing a branch well from the main access well bore.

Referring now to FIG. 12, a schematic illustration of a type of a seal sealing a branch well bore from the main access well bore with a tail pipe extension is shown. In the embodiment shown, the branch well bore may be the branch well bore 32 depicted in FIG. 4 that extends from the main access well bore 2. The packer 202 for sealingly engaging the branch well bore 32 is commercially available from Baker Hughes Incorporated and sold under the packer model number "SC-1". The packer 202 has internal bore 204 that will have disposed therein a tail pipe 206. The tail pipe 206 will extend below the packer 202 as least partially to the productive interval. The tail pipe 206 will have contained therein a landing profile 208 for landing an apparatus, such as a plug, orifice, plug, pressure probe, or other production monitoring sensor. Another apparatus that is possible to land into the landing profile 208 is latch placement of operatively associated production equipment such as the [three-phase] separator, chemical injection or catalytic/reactor devices.

Figure 13:
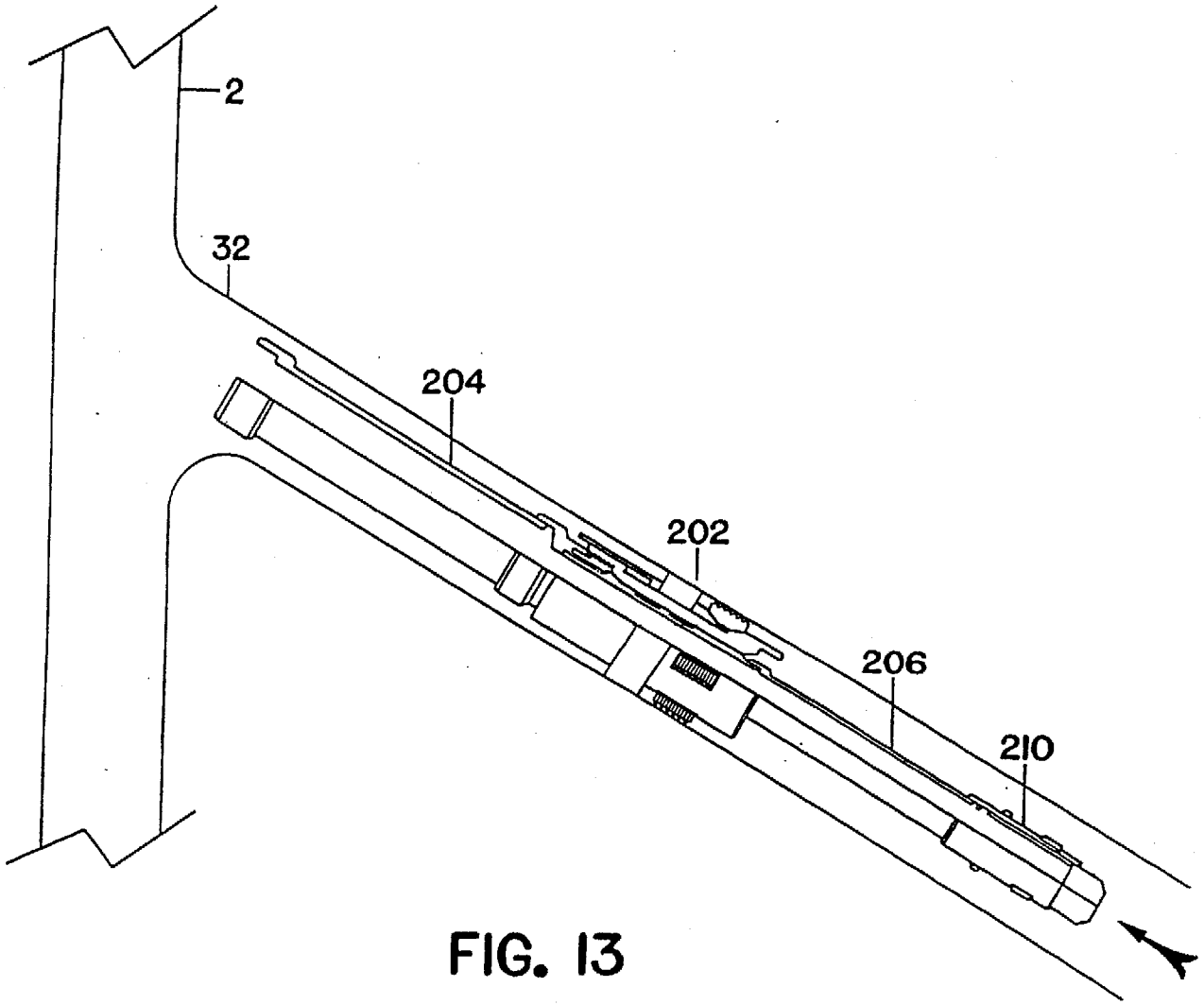
FIG. 13 depicts the embodiment of FIG. 12 showing a regulator disposed therein.

FIG. 13 depicts the packer means 202 of FIG. 12 with the tail pipe 206 extending therefrom. The embodiment of FIG. 13 has a control means 210 for controlling the production into the main access well bore 2. In the embodiment shown, a choke is provided which is a variably controlled valve that will cause a pressure drop at the point of orifice restriction that is well known in the art. The purpose of having the down hole choke is that production from the reservoir is restricted to a limited extent because of the pressure drop created at the restriction. The pressure drop may be used to balance production from several of the open zones, i.e. assist in commingling. Also, the choke may be used for regulating the amount of lift gas from a zone as in FIG. 9A so as to optimize oil production while not unnecessarily depleting the hydrocarbons and pressure available from the reservoir.

Figure 14:
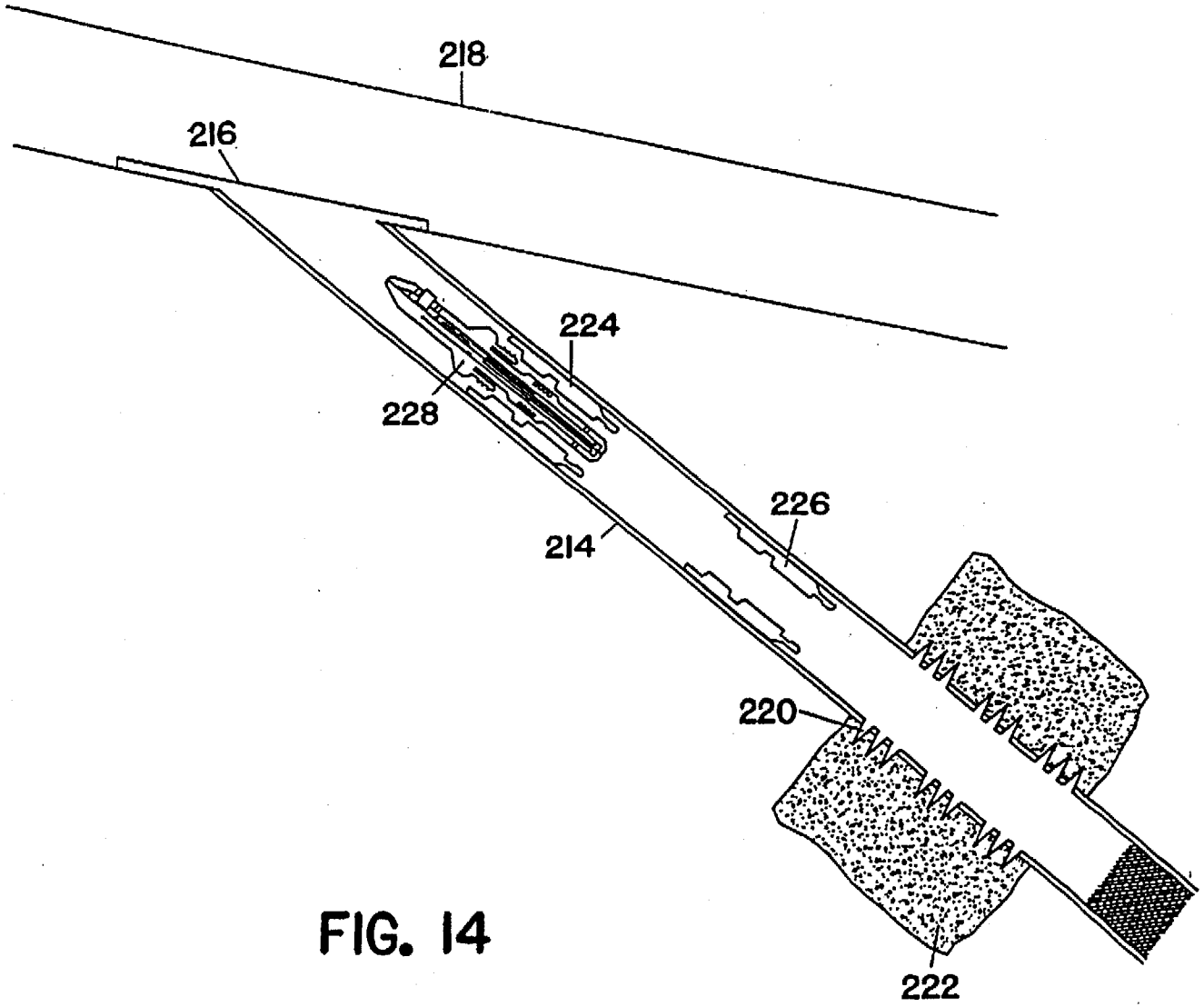
FIG. 14 is a schematic illustration of another embodiment of a branch well bore with a regulator disposed therein.

Yet another embodiment is shown in FIG. 14. A branch well bore 214 extends from a window section 216 of the main access well bore 218. This particular branch well bore 214 will have a series of perforations 220 that communicate the internal diameter of the branch well bore 214 with the reservoir 222. The branch well bore will also contain landing profiles 224 and 226. As depicted in FIG. 14, a control valve 228 for opening and closing the branch well bore 214 from communication with the main access well bore 218 is provided. The control valve is operable between an open position and a closed position. The control valve 228 is retrievable and resettable. The landing profile 226 is generally a back-up profile landing receptacle for a plug. These type of landing profiles 224, 226 are generally incorporated into the casing strings 214.

Referring to FIGS. 15 through 19, the down hole disk centrifuge separator and pump 250 will now be described. As depicted in FIG. 15, the down hole disk centrifuge separator/pump 250 may be adapted for use in either a main access well bore or branch well bore. In the preferred embodiment, the separator 250 is positioned in a well bore 251 that may be a main access well bore as previously described in FIG. 6. However, the separator/pump 250 of this application is functional in both a main access well as well as a branch well bore. Thus, the separator 250 is operative in an environment similar to FIG. 6, but may also be placed within a branch well as seen in FIGS. 5, 7, 8, and 11. Further, the separator/pump 250 may be placed in either a vertical, deviated or horizontal inclination within a well.

In the embodiment shown in FIG. 15, the separator/pump 250 is positioned within a main access well bore 240 at an essentially vertical inclination. Production of fluids from a reservoir has been delivered to the separator/pump 250 via the lower perforations 242. The separator/pump 250 is positioned in conjunction with a packer 244 that sealingly engages the main access well bore 240.

The separator/pump 250 will generally comprise an outer casing 252 that is generally cylindrical in shape. The outer casing 252 will have an inlet 254 and an outlet 256. The outer casing 252 has generally a top conical end 258 and a bottom end 260 that is generally a radially flat surface.

The shaft 262 extends from the inlet 254 to the outlet 256, with the shaft 262 being attached at one end to gear box 264A, the gear box 264*a* being attached to a motor 264 which is connected to the shaft 262 in order to impart rotation to the shaft 262. The motor 264 can be fixed speed or variable speed and is electrical (dc or ac) or equivalent that can stand the harsh down hole environment. An example of such a motor assembly is available from Centrilift Incorporated under the product name 562 Electric Submersible Motor Series.

The shaft 262 will have attached thereto an internal base member 266 which is of generally conical configuration. The bottom end 260, the base member 266, the feed distributor 267 and a set of generally radial vanes 268A form a passageway 268 for the incoming feed oil/water slurry which has been produced by the reservoir. The feed distributor 267, vanes 268*a* and passageway 268 acts as a vaned-pump when the motor is energized so that as the shaft 262 rotates, the feed enters the inlet 254, and is being accelerated to a solid-body rotation where the tangential velocity is linearly proportional to the radius for a given angular speed (revolution per minute) of the vaned pump. After the feed has acquired this tangential velocity, a centrifugal body force develops which moves the feed radially outward. As shown in FIG. 15, the shaft 262 enters the base member 266 at the foundation portion 270 and exits at the apex 272. The base member 266 is attached to the shaft 262 so that the base member 266 rotates in sync with the shaft 262.

A plurality of conical disk 276A–276H are shown in conjunction with the separator 250. As the feed is brought to the internal diameter of the outer casing 252 via the feed distributor 267 and the passageway 268, the feed flows into the disk stack 276A–H by pressure difference between the inlet 254 and outlet 256 of separator 250. The spacing 275A of the conical disks 276A–H are usually 5–30 mm depending on application (size of foreign objects such as formation sand grains which can clog the disk stack) and adjacent disks form conical channels through which the slurry is fed for separation. As depicted in FIG. 15, eight individual disk have been employed. However, any number could be used. In accordance with the teachings of this invention, as the number of disk stacked in relation to one another increases, the effective area of separation also increases. Therefore, the number of individual disk may vary depending on size limitations, the throughput of the slurry and the degree of separation required.

Figure 16:
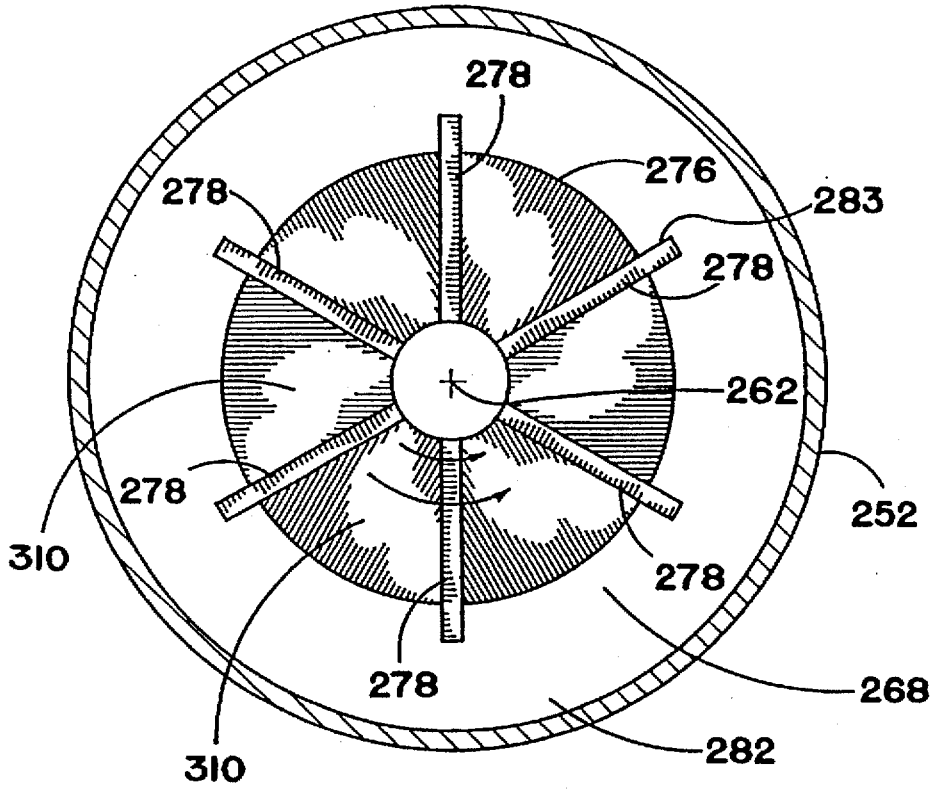
FIG. 16 is a top view of a disk member of the present invention.

The individual disk 276 will have contained thereon a series of accelerating vanes 278 (also known as ribs) which is also shown in FIG. 16. In the preferred embodiment, an individual disk 276 contains a multiple number of accelerating vanes 278 spaced uniformly about the circumference with six vanes shown in FIG. 16; however, the exact number depends on the size of the disk and other restrictions on dimension. Referring again to FIG. 15, the stack of disk 276A–H will be connected to a series of radial spokes 279 for attachment to the shaft 262 so that each disk 276 is rotated with the shaft 262. An annular support 280, also attached to the spokes 279, are attached to the plurality of disk 276A–H. The spokes 279, annular support 280 and the shaft 262 form an annular passage area 281. An outer annular space 282 is also formed from the radial ends of the disks 276 and casing 252. Also included will be axial vanes 283 for maintaining the slurry in solid-body rotation to sustain centrifugal force for separation and for channeling the in situ water to the produced water outlet and valve means for controlling the opening 284 and any back pressure contained therein. Extending radially inward is the small diameter 286 of the disk that channels the separated oil to the annular space 281 from which it flows axially upward to the centrifuge pump 296.

As depicted in FIG. 15, the outer casing 252 has an opening 290 that has associated therewith an output tubing 292 for discharging the separated water. Ultimately, the tubing leads to a reinjection zone (not shown) wherein the separated waste water is reinjected. The reinjected zone may be the same reservoir (in the case of pressure maintenance or water flooding) or to a reservoir having desirable injection characteristics (such high porosity, high permeability or low bottom hole pressure).

The centrifuge pump 296 for pumping the output oil to the surface generally comprises a stationary outer housing 298 that has therein an impeller blade assembly 300. The stationary outer housing 298 is connected to the outer casing 252. The impeller blade 300 is generally configure of a backwardly curve (with respect to direction of rotation, at increasing radius i.e. opposite to direction of rotation, even though other contours are possible. The internal portion of the stationary housing has a shaped suited to adapt the impeller blades 300. The impeller blade 300 is attached to the shaft 262 so that rotation of the shaft 262 imparts rotation to the impeller blade 300. The stationary outer housing contains an opening 302 that has connected thereto an output tubing 304 so that the oil which has been separated may be pumped to the surface. A seal arrangement 305 has been provided between the rotation part of the disk assembly 276 and the stationary housing 252.

Operation of the separator/pump 250 and centrifuge pump 296 will now be described. The hydrocarbons from the reservoir together with the produced water flow into the casing through the completion as is well understood by those of ordinary skill in the art. Due to a pressure difference between the slurry inlet 254 and the oil outlet 256 and the water outlet 284, the feed fluid enters the inlet 254. The feed is accelerated by the vanes 268*a* to a solid-body rotation so that it acquires the centrifugal force for separation, and the feed is driven to the annular space 268 and up the conical channels 310 formed by the stacked disk 276A–H. Oil-water separation takes place in the annular space 268 and primarily in the conical channels 310. By accelerating the feed from zero radius, it provides a gentle acceleration of the feed to a state of solid-body rotation without inducing more emulsion in the course of imparting momentum to the feed slurry as with prior art centrifuge separators which have poor feed acceleration. Likewise, the gentle deceleration by the radial vanes ensures no excess energy goes into free vortex which is dissipated and causes emulsion.

As the produced fluids are brought to the disks area 276, the flow pattern within the separator 250 is induced due to the pressure difference between the inlet 254 and outlet 256. The individual conical disk 276 are usually spaced 5–30 mm apart depending on application i.e. formation grain sand size. The adjacent disk, for instance 276A & 276B, together with the attached vanes 278 form conical channels through which the slurry is fed for separation. FIG. 16 shows a top view of a disk 276 that has radial vanes 278 disposed thereon and wherein the radial vanes 278 are used to space out the disk 276A–H as well as a means to counteract the Coriolis force as the fluid moves radially inward or outward subject to this undesirable influence, which causes free vortex (overspeeding) or slippage, resulting in complicated secondary flow which dissipates energy of the fluid stream. The radial vanes can be discontinuous 278B to allow a limited mixing of fluid between adjoining conical channels 310.

Figure 17:
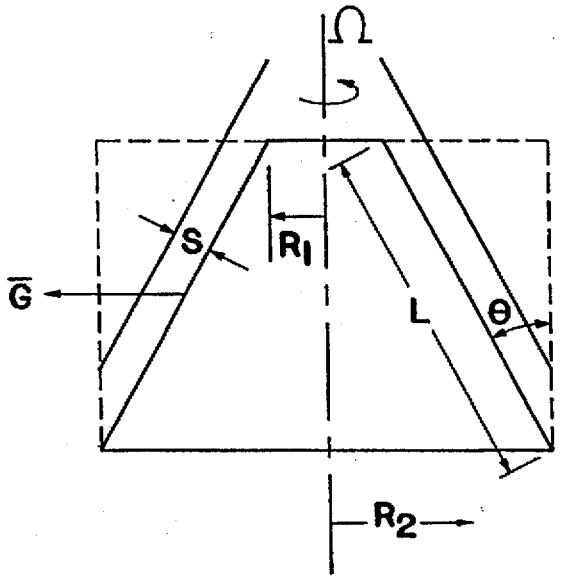
FIG. 17 is a cross section of a disk member.

FIG. 17 depicts a cross-section of disk 276 showing two disk. By increasing the number of these conical disks in close spacing S, the effective separation area is increased by factors of tens and hundreds. This is important for down hole separation where spacing is limited. For example, with 30 disks at 30 degrees (theta) included half angle (measured from the axis of the shaft), an increase of 22.5 times is achieved. If the spacing of the disk is 10 mm, 30 disks span an axial distance of 300 mm or 12 in.

Figure 18:
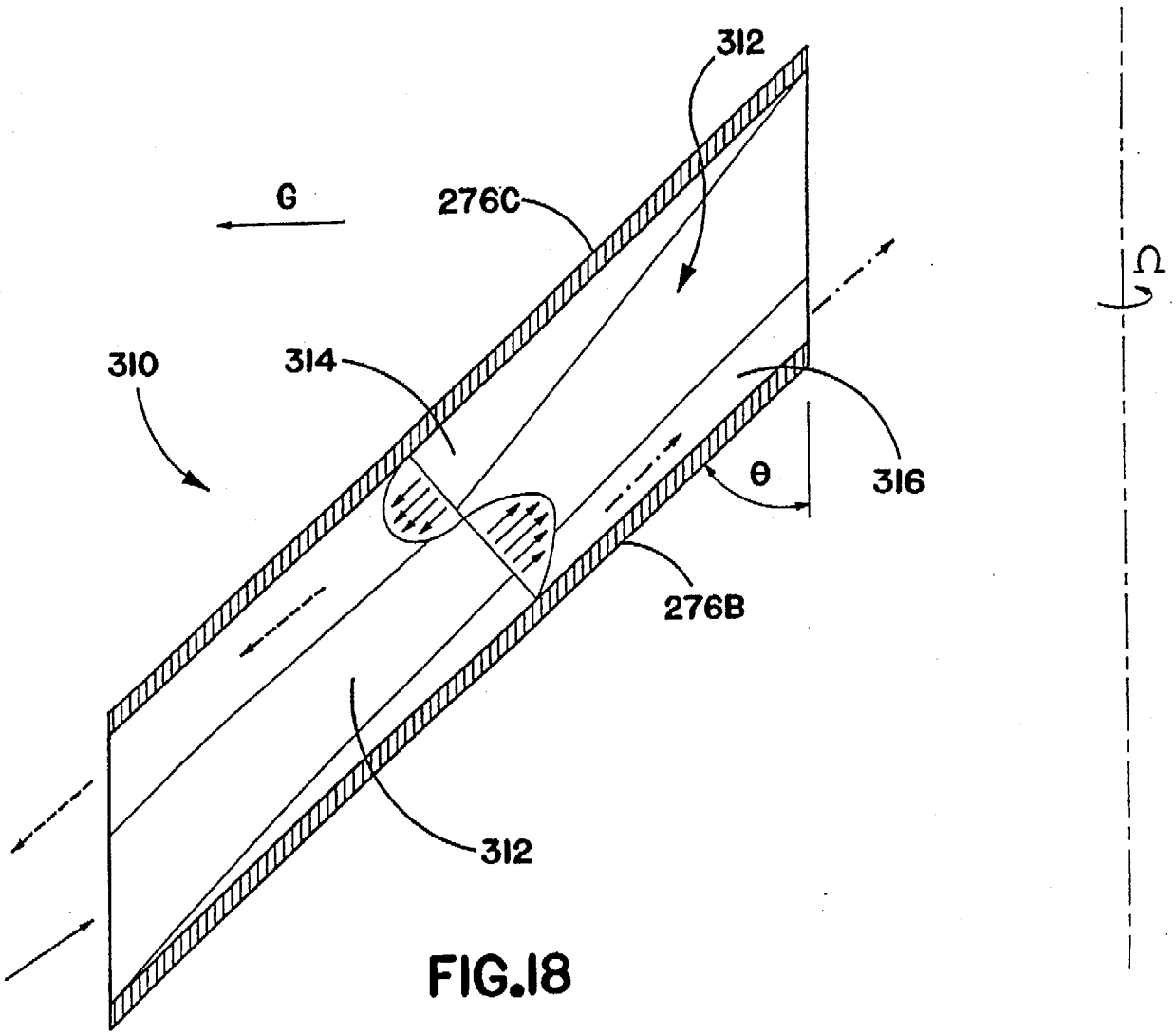
FIG. 18 is a cross section of two adjacent disk members, stacked in series, depicting a flow profile within the conical channel formed during separation.

FIG. 18 is a cross section in the radial plane of the conical channel 310 formed by two adjacent disks (276B and 276C). As depicted under centrifugal gravity G, a stratified flow pattern 320 is developed during rotation of the shaft 262 such that the feed 312 occupies the central portion of the channel 310, the separated heavier water 314 occupies the adjacent area to the underside of the top disk 276C, whereas the lighter oil layer 316 is on the upper side of the bottom disk 276B. Under buoyancy force, the light oil flows to the smaller radius whereas the heavy water layer flows to the large radius.

In the preferred embodiment, a stationary outer casing 252 is employed. In order to maintain the feed at solid-body rotation as it enters the disk channels 310 across the entire stack 276A–H, rotating axial vanes 283 (also referred to as ribs) are employed. Otherwise, the flow would slow down in contact with the stationary casing 252. The vanes 278 in the conical disks can be designed as continuation of vanes 283 and the feed accelerating vanes 268*a* at the feed passageway 268 or can be separately attached.

Thus, the oil phase 316 inherently moves radially inward during rotation (as shown by the bold arrows in FIG. 15) and the water phase 314 inherently moves radially outward during rotation (as shown by the dotted arrows in FIG. 15). The oil phase 316 is decelerated as it flows radially inward by the radial vanes 278. Energy is extracted in this process and fed back into the rotating assembly.

Referring again to FIG. 15, the separated oil phase leaves the disk channels 310 at the small radius and flows into an annular area 281 wherein the oil phase 316 flows up to the intake 256 of the centrifugal pump 296.

The water phase 314 leaves the disk channel 310 at the large radius and collects at the outer annular space 283 adjacent to the housing wall 252. The waste water flows up to an annular space 318 adjacent to the opening 290 at the top of the disk stack 276 and is allowed to be in contact with a series of radial vanes 278C. As the water flows into the annular area 283, the radial vanes 278C decelerate the flow and maintain the fluid as a solid-body rotation without free vortex. The water can be discharged at a prescribed radius which can change with an adjustable mechanism (sliding cover on a radial slot) mounted at the top of the housing 258. The larger the discharge radius, the higher the kinetic energy of the discharged water stream because the tangential velocity of the fluid is linearly proportional to the radius under solid-body rotation. The kinetic energy of the discharged water is ideally controlled so that it is adequate for reinjecting the water back into the reinjection zone overcoming the formation pressure. Under some circumstances, a separate down hole reinjection pump is used to assist reinjection.

The acceleration vanes 268A, axial vanes 283, and the decelerating vanes 278C form a rugged cage assembly for the disk stack 276A–H with vanes 278. This rugged cage assembly allows the disk centrifuge separator/pump 250 to operate at high rotational speeds. There are many ways of attaching the set of vanes onto each other, for example the vanes 278 can be bolted ont vanes 283 through lap joint arrangement.

The separated oil 316 from the disk stack 276 has little kinetic energy as it is discharged at the inner annular passage 281 and small radius. Thus, the centrifuge pump 296 is employed as previously mentioned. Thus, rotation of the impeller blade 300 within the stationary housing 298 creates the pumping action necessary to pump the oil to the surface through the output channel 302 and tubing 304.

A high torque, low speed macerator 326 has also been included. The macerator 326 will grind the formation sand grains, as well as other solids, that are entrained within the feed so that the solids do not make their way through the separator/pump 250 which causes excessive wear and corrosion, as well as clogging of the disk channels.

Figure 19:
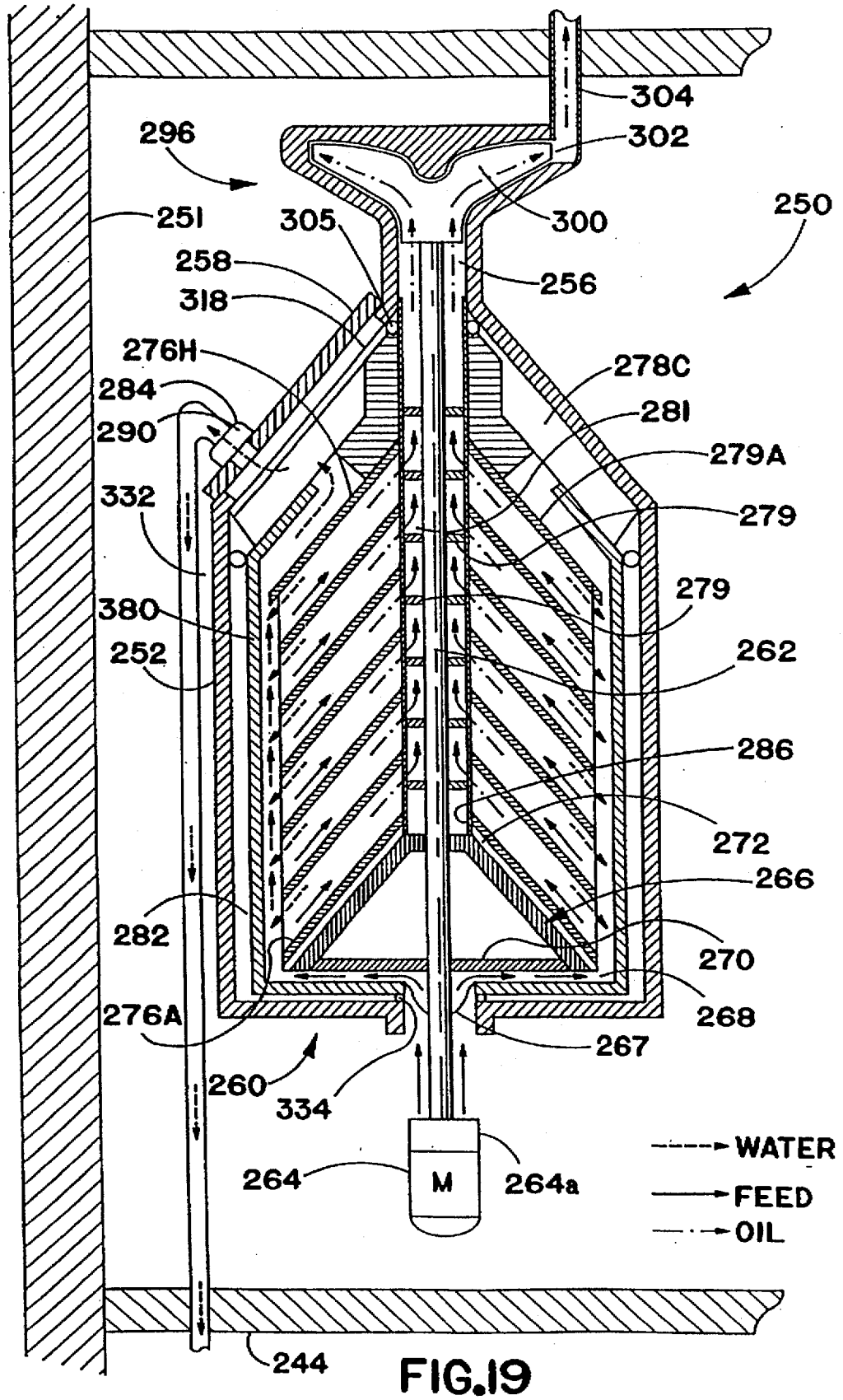
FIG. 19 is a second embodiment of the present invention with a rotating bowl situated within a stationary casing.

The second embodiment of the invention is shown in FIG. 19. This embodiment is similar to the embodiment of FIG. 15. As shown, there is no axial vanes (ribs) because the bowl 330 is also rotating to maintain rotation of the feed. In this embodiment, the disk stack 276A–H is stationary and a rotating inner bowl 330 has been attached to the shaft 262. The tangential velocity is imparted on the feed at the outer radius of the disk stack by this rotating inner bowl 330. Additional seals 305, 334 have been included in order to seal the water discharge area whereas seal 304 is used to seal feed from entering the annular space between the stationary casing and rotating bowl 330. The top conical piece 279A, also referred to as a conical baffle, has a large outer radius as compared to the cones in the disk stack 276 to ensure that the oil phase does not entrain into the already separated water phase.

A third embodiment is also possible wherein the disk stack 276A–H is again stationary, however, the tangential velocity is imparted on the feed at the outer radius of the stack by rotating the outer radial-axial vane assembly. In this embodiment and the embodiment of FIG. 19, radial vanes may still be used to space out the disk stack 276 and damp out the free vortex.

Changes and modifications in the specifically described embodiments can be carried out without departing from the scope of the invention which is intended to be limited only by the scope of the appended claims.

We claim:

1. A method for recovering hydrocarbons from subterranean formations, having at least one producing zone and one disposal zone, through a multilateral wellbore having at least one branch wellbore, wherein the method comprises:

extending a primary access wellbore from a surface location to a downhole location, the primary access wellbore presenting a first flow passage in fluid communication with a subterranean reservoir;

intersecting the primary access wellbore with a branch wellbore presenting a second flow passage in fluid communication with a subterranean reservoir, with one of the flow passages being in fluid communication with a producing zone and the other passage being in fluid communication with a disposal zone;

providing a phase separation processing unit in the branch wellbore separating phases of production fluids received from the producing zone;

providing a packer in the branch wellbore blocking fluid flow in the branch wellbore, the packer having a transfer port therein in flow communication with the processing unit directing fluid flow in the branch wellbore via the processing unit;

delivering production fluids from the producing zone to the subterranean processing unit located within the branch wellbore;

processing the production fluids in the subterranean processing unit to separate the production fluids into a hydrocarbon production phase and an in-situ disposal phase;

delivering the separated hydrocarbon production phase from the subterranean processing unit to the surface through the primary access wellbore; and delivering and re-injecting the separated in-situ disposal phase from the subterranean processing unit into the disposal zone through the flow passage in fluid communication with the disposal zone whereby the primary wellbore remains free of processing units and associated equipment and open for fluid flow and mechanical intervention below the branch wellbore.

2. The method as set forth in claim 1, wherein the production fluids are separated with a fluids separator selected from the group consisting of a centrifugal-type separator, a cyclone-type separator and a rotating-bowl separator.

3. The method as set forth in claim 1, wherein the production fluids are separated with a separator selected from the group consisting of a liquid-gas separator, a liquid-liquid separator, and gas-liquid-liquid separator.

4. The method as set forth in claim 3 wherein the production fluids are selected from the group consisting of:

a liquid hydrocarbon production phase, a gas hydrocarbon phase and an in-situ water disposal phase.

5. The method as set forth in claim 1 wherein:

the branch wellbore intersects a producing zone.

6. The method as set forth in claim 1 wherein:

the branch wellbore intersects a disposal zone.

7. The method as set forth in claim 1 further comprises:

providing a flow control apparatus in the branch wellbore.

8. The method as set forth in claim 1 wherein:

the subterranean processing unit further comprises a submersible pump assembly for delivering the hydrocarbon production phase to the surface and for re-injecting the in-situ disposal phase in the disposal zone.

9. The method as set forth in claim 1 further comprises:

intersecting the primary access wellbore with a further branch wellbore presenting a flow passage in fluid communication with a subterranean reservoir.

10. The method as set forth in claim 9, wherein separating the production fluids in a three-phase fluids separator into a liquid hydrocarbon production phase, a gas hydrocarbon phase and an in-situ water disposal phase.

11. The method as set forth in claim 10, further comprises:

delivering the liquid hydrocarbon and the gas hydrocarbon production phases, separately, to the surface through the primary access wellbore from the subterranean processing unit; and delivering and re-injecting the in-situ disposal phase into a disposal zone.

12. The method as set forth in claim 11 further comprises:

delivering the in-situ disposal phase to the disposal zone at a pressure sufficient to maintain the reservoir pressure above a bubble point.

13. A wellbore system for recovering hydrocarbons from subterranean formations, having at least one producing zone and at least one disposal zone, through a wellbore having at least one branch wellbore comprising:

a primary access wellbore extending from a surface location to a downhole location, the primary access wellbore presenting a first flow passage in fluid communication with a subterranean reservoir;

a first branch wellbore intersecting the primary access wellbore presenting a second flow passage in fluid communication with a subterranean reservoir with one of the flow passages being in fluid communication with a producing zone and the other passage being in fluid communication with a disposal zone;

a phase separation processing unit in the branch wellbore separating phases of production fluids received from the producing zone into a hydrocarbon production phase which is delivered to the surface and an in-situ disposal phase which is re-injected into the disposal zone; and a packer in the branch wellbore blocking fluid flow in the branch wellbore, the packer having a transfer port therein in flow communication with the processing unit directing fluid flow in the branch wellbore via the processing unit;

whereby the primary wellbore remains free of processing units and associated equipment and open for fluid flow and mechanical intervention below the branch wellbore.

14. The fluids separator as set forth in claim 13 is selected from the group consisting of a centrifugal-type separator, a cyclone-type separator and a rotating-bowl separator.

15. The wellbore system as set forth in claim 13 further comprises:

a flow control apparatus located in the branch wellbore.

16. The wellbore system as set forth in claim 13 wherein:

the branch wellbore intersects the producing zone.

17. The wellbore system as set forth in claim 13 wherein:

the branch wellbore intersects a disposal zone.

18. The subterranean processing unit in the wellbore system as set forth in claim 13 further comprises:

a pump associated with the separator for delivering the hydrocarbon production phase to the surface while re-injecting the in-situ disposal phase to the disposal zone.

19. The wellbore system as set forth in claim 13 further comprises:

a second branch wellbore intersecting the primary wellbore and presenting a flow passage in fluid communication with a subterranean reservoir.

20. The wellbore system as set forth in claim 13 wherein the separator further comprises:

a) a housing with an inlet for receiving the production fluids and at least two outlets for discharging the production fluids after separation;

b) a shaft axially mounted with the housing;

c) a plurality of disc stages operatively associated with the shaft for separating the production fluids;

d) a motor operatively associated with the shaft.

21. The wellbore system as set forth in claim 20 wherein:

the disks have a generally conical shape to impart varying centrifugal forces to the production fluids along its radial diameter to thereby effect separation of the production fluids into the hydrocarbon production phase and the in-situ disposal phase.

22. The wellbore system as set forth in claim 21 further comprising:

a rotating inner bowl within the housing operatively associated with the disk stages to thereby impart varying centrifugal forces to the production fluids to effect further separation of the production fluids into the hydrocarbon production phase and the in-situ disposal phase.

23. A method for treating recovered hydrocarbons from subterranean formations through a wellbore, wherein the method comprises:

providing a primary access wellbore which extends from a surface location to a downhole location;

intersecting the primary access wellbore with a first branch wellbore extending outwardly;

providing a subterranean fluid treatment device, positioned at least in part in the first branch wellbore treating fluid received at the device to enhance selected properties of the fluid;

delivering fluid to the subterranean treatment device;

treating the fluid at the subterranean treatment device; and delivering the treated fluid to the surface through the primary access wellbore from the subterranean treatment device.

24. The method as set forth in claim 21 further comprises:

inserting an impermeable liner in the first branch wellbore for storing the treating chemical.

25. The method as set forth in claim 21 further comprises:

treating the fluids with a treating chemical selected from a group consisting of a hydrate inhibitor, a corrosion inhibitor, a paraffin wax inhibitor, a scale inhibitor, a hydrogen sulfide scavenger, a water clarifier and an emulsion breaker.

26. The method as set forth in claim 23 wherein:

said treating comprises adding treatment chemical stored in the first branch wellbore to the fluid delivered to the treatment device.

27. The method as set forth in claim 23 wherein:

the treating comprises cracking the fluid in a catalyst bed in the branch wellbore and modifying the hydrocarbon molecular composition of the fluid received at the device.

28. A wellbore system for recovering treated hydrocarbons from a subterranean formation comprising:

a primary access wellbore extending from a surface location to a downhole location;

a branch wellbore intersecting the primary access wellbore;

a subterranean treatment device located, at least in part, within the branch wellbore treating fluid received at the device to enhance selected properties of the fluid; and whereby the primary access wellbore, the branch wellbore and the subterranean treatment device together produce, treat and deliver fluids downhole.

29. The wellbore system of claim 28 wherein the subterranean treatment device comprises chemical storage in the branch wellbore.

30. The wellbore system of claim 28 wherein the subterranean treatment device comprises a catalyst bed in the branch wellbore.

* * * * *